US006911612B2

(12) United States Patent
Seki

(10) Patent No.: US 6,911,612 B2
(45) Date of Patent: Jun. 28, 2005

(54) SWITCH

(75) Inventor: Hiroshi Seki, Tokyo (JP)

(73) Assignee: Niles Parts Co., Ltd. (JP)

( * ) Notice: Subject to any disclaimer, the term of this patent is extended or adjusted under 35 U.S.C. 154(b) by 0 days.

(21) Appl. No.: 10/216,235

(22) Filed: Aug. 12, 2002

(65) Prior Publication Data

US 2003/0042120 A1 Mar. 6, 2003

(30) Foreign Application Priority Data

Feb. 28, 2002 (JP) ..... P2002-052877

(51) Int. Cl.[7] ..... H01H 3/00
(52) U.S. Cl. ..... 200/339; 200/315; 200/553
(58) Field of Search ..... 200/339, 315, 200/553, 449, 308

(56) References Cited

U.S. PATENT DOCUMENTS 3,928,743 A * 12/1975 Ohashi ..... 200/308
5,053,594 A * 10/1991 Thota et al. ..... 200/315
5,446,253 A * 8/1995 Oshgan ..... 200/556
5,561,279 A * 10/1996 Hattori et al. ..... 200/6 R
5,662,213 A * 9/1997 Kattler et al. ..... 200/302.3
5,743,382 A * 4/1998 Luo ..... 200/315
5,752,595 A * 5/1998 Fein et al. ..... 200/315
5,810,109 A * 9/1998 Chu ..... 200/308

* cited by examiner

*Primary Examiner*—Kyung Lee
(74) *Attorney, Agent, or Firm*—Rader, Fishman & Grauer PLLC

(57) ABSTRACT

To provide a switch that can hold a switch knob at neutral and prevent play while reducing a number of parts. In the switch, an operating lever portion of a switch knob is inserted from an opening of a knob attaching portion provided at a switch case and the switching knob is axially supported by the knob attaching portion to be capable of operating to pivot, wherein an elastic pin portion is integrally provided to the switch knob, an engaging hole for engaging the elastic pin portion is provided to a side of the switch case, and when the switch knob is operated to pivot, the switch knob is urged to a neutral portion relative to the knob attaching portion by elastic force by deforming the elastic pin portion to the engaging hole.

7 Claims, 15 Drawing Sheets

SWITCH

BACKGROUND OF THE INVENTION

1. Field of the Invention

The present invention relates to a switch such as a seesaw type switch, a lever type switch or the like used in a power window switch or the like.

2. Description of the Related Art

There is a conventional seesaw type switch as shown by, for example, FIG. 25. FIG. 25 is a sectional view in a state of attaching a switch knob, showing a neutral holding structure the switch knob.

As shown by FIG. 25, according to a seesaw type switch 201, a switch knob 203 is axially supported by a knob attaching portion 207 of a switch case 205 pivotably around, for example, a pivoting center C and capable of operating pivoting movement. Therefore, when the switch knob 203 is operated to push to thereby pivot around the pivoting center C in the counterclockwise direction, power window of an automobile is operated to lower. Further, when the switch knob 203 is pulled up to thereby pivot around the pivoting center C in the clockwise direction, the power window is operated to lift.

Such a switch knob 203 is held by a neutral holding mechanism 209 at a neutral position at which the power window is not operated to lift or lower. That is, a spring containing portion 211 is provided in the switch case 205. A coil spring 213 is contained in the spring containing portion 211. A steel ball 215 is arranged at an upper end of the spring containing portion 211. The steel ball 215 is brought into elastic contact with a recessed portion 217 of the switch knob 203.

Therefore, by an urging force of the coil spring 213, the steel ball 215 is brought into elastic contact with the recessed portion 217 of the switch knob 203 and the switch knob 203 is held at the neutral position.

In operating the switch knob 203, the recessed portion 217 of the switch knob 203 can be moved relative to the steel ball 215 to thereby enable to pivot the switch knob 203. Further, after the switch knob 203 is operated to press or operated to pull up, when the switch knob 203 is detached, the switch knob 203 can automatically return to the neutral position of FIG. 25 by elastic contact of the steel ball 215 with the recessed portion 217.

In this way, by the neutral holding mechanism 209, the switch knob 203 can be held at the neutral position and the play of the switch knob 203 can be prevented.

However, according to the above-described structure, in integrating operation, there is constituted a procedure of containing the coil spring 213 in the spring containing portion 211, thereafter inserting the steel ball 215 thereinto, coating grease and integrating the switch knob 203 and therefore, there poses a problem that a number of integrating steps is large.

Further, according to the structure as shown in FIG. 25, there is a concern of bringing about a failure in step such as a failure in inserting the coil spring 213, detachment of the steel ball 215 or the like and there is a concern of bringing about trouble in operation of the switch knob 203.

Further, a number of parts of the coil spring 213, the steel ball 215 and the like is large and integration and parts control are complicated to thereby cause to increase cost.

SUMMARY OF THE INVENTION

It is an object of the invention to provide a switch of a seesaw type switch, a lever type switch or the like capable of achieving a reduction in cost by reducing a number of parts, reducing a number of integration steps, restraining occurrence of a failure in step and facilitating integration and parts control.

The invention of a first aspect is concerned with a switch wherein an operating lever portion of a switch knob is inserted from an opening of a knob attaching portion provided at a switch case and the switch knob is axially supported by the knob attaching portion to be capable of operating to pivot, an elastic portion is integrally provided with either one of the switching knob or the switch case and a receive portion for receiving a reactive force of the elastic portion is provided at the other end thereof, and when the switch knob is operated to pivot, the switch knob is urged to a neutral position relative to the knob attaching portion by an elastic force by deforming the elastic portion to the receive portion.

According to the invention of a second aspect, in the switch according to the first aspect, the elastic portion is an elastic projection projected from the switch knob into the opening of the knob attaching portion, and the receive portion is an engaging hole provided to the knob attaching portion for fitting and holding a front end of the elastic projection.

According to the invention of a third aspect, in the switch according to the second aspect, the engaging hole is provided at a bottom portion of a spring containing portion capable of containing a coil spring used in a switch knob having other specifications, and the bottom portion of the spring containing portion is formed in a shape of a taper hole converging toward the engaging hole.

According to the invention of a fourth aspect, in the switch according to the first aspect, the elastic portion is an elastic leg portion projected from the switch knob to an outer face of the switch case, wherein the receive portion is an outer face of the switch case, and the elastic leg portion is brought into elastic contact with the outer face of the switch case.

According to the invention of a fifth aspect, in the switch according to the fourth aspect, the outer face of the switch case is provided with a groove for fitting and guiding a front end of the elastic leg portion.

According to the invention of a sixth aspect, in the switch according to the first aspect, the elastic portion is formed by providing a through hole at an edge portion of the switch knob, wherein at either one of the elastic portion and the receive portion, a projection in contact with the other side is provided, and the elastic portion is deformed by changing a situation of bringing a side of the elastic portion or a side of the receive portion into contact with the projection by operating to pivot the switch knob.

According to the invention of a seventh aspect, in the switch according to any one of the first to sixth aspects, a fixed contact is fixedly supported by a terminal block engageably and detachably attached to the switch case, a movable piece having a movable contact brought into contact with or separated from the fixed contact is pivotably supported and a slider having an elastic contact member brought into elastic contact with the movable piece and a cooperative engaging portion for engaging with the operating lever portion is movably supported, and the slider is moved in cooperation with the operating lever portion by operating to pivot the switch knob, the movable piece is pivoted by moving the elastic contact member on the movable piece and the movable contact is brought into contact with and separated from the fixed contact.

According to the invention of the first aspect, the operating lever portion of the switch knob is inserted from the opening of the knob attaching portion provided at the switch case and the switch knob can axially be supported by the knob attaching portion to be capable of operating to pivot. Therefore, the contact can be connected and disconnected by operating to pivot the switching knob relative to the knob attaching portion. Further, the elastic portion is integrally provided to either one of the switch knob side and the switch case side, the receive portion for receiving the reactive force of the elastic portion is provided at the other end thereof, the switch knob is urged to the neutral portion relative to the knob attaching portion by the elastic force by deforming the elastic portion to the receive portion when the switch knob is operated to pivot and therefore, when the finger is separated after operating to pivot the switch knob, the switch knob can be returned to the neutral position and held relative to the knob attaching portion. Further, in integrating operation, the elastic portion integral to the switch knob is only engaged with the receive portion on the switch case side and therefore, a number of integrating steps is small and occurrence of a failure in step can considerably be restrained. Further, since a number of parts is small, integration and parts control are facilitated and a significant reduction in cost can be achieved.

According to the invention of the second aspect, in addition to the effect of the invention of the first aspect, the elastic portion is the elastic projection projected from the switch knob into the opening of the knob attaching portion, the receive portion is the engaging hole provided at the knob attaching portion for fitting and holding the front end of the elastic projection and therefore, in inserting the operating lever portion of the switch knob from the opening of the knob attaching portion, the elastic projection can be fitted to and held by the engaging hole. Therefore, integrating is facilitated and occurrence of a failure in step can firmly be restrained. Further, the switch knob can automatically be returned to the original neutral portion by the elasticity of the elastic projection.

According to the invention of a third aspect, in addition to the effect of the invention of the second aspect, the engaging hole is provided at the bottom portion of the spring containing portion capable of containing the coil spring used in the switch knob having other specification, the bottom portion of the spring containing portion is formed in the shape of the taper hole converging toward the engaging hole and therefore, in integration, when the elastic projection is inserted into the spring containing portion and the front end is butted to the bottom portion, the front end of the elastic projection can be fitted to the engaging hole by being guided by the bottom portion in the shape of the taper hole. Further, when the elastic projection is inserted with the spring containing portion larger than the engaging hole as a measure, as-described above, the elastic projection can be inserted into the engaging hole. Therefore, integration can further be facilitated and occurrence of a failure in step can be restrained further firmly. Further, the spring containing portion can contain the coil spring used in the switch knob having another specification and the switch knob having the other specification, for example, a switch knob of an auto switch can be attached by commonly using the switch case.

According to the invention of a fourth aspect, in addition to the effect of the invention of the first aspect, the elastic portion is the elastic leg portion projected from the switch knob to the outer face of the case, the receive portion is the outer face of the case, the elastic leg portion is brought into elastic contact with the outer face of the case and therefore, by only carrying out an operation of attaching the switch knob to the knob attaching portion, the elastic leg portion can be brought into elastic contact with the outer face of the switch case. Therefore, special consideration for bringing the elastic leg portion to the outer face of the switch case is dispensed with, integration is further simplified and occurrence of a failure in step can further firmly be restrained. Further, by making the elastic leg portion elastically spring to the outer face of the switch case in the state of integrating the switch knob, the elastic spring force can be operated to a portion of the switch knob axially supported by the switch case and play of the switch knob relative to the knob attaching portion can further firmly be prevented.

According to the invention of a fifth aspect, in addition to the effect of the invention of the fourth aspect, the groove for fitting and guiding the front end of the elastic leg portion is provided at the outer face of the switch case and therefore, movement of the elastic leg portion can be stabilized and operation feeling of the switch knob can be promoted. Further, in integrating the switch knob, the hand of the operator can be prevented from touching the elastic leg portion and destruction of the elastic leg portion can be prevented.

According to the invention of a sixth aspect, in addition to the effect of the invention of the first aspect, the elastic portion is formed by providing the through hole at the edge portion of the switch knob, at either one of the elastic portion and the receive portion, the projection in contact with the other side is provided and the elastic portion can be deformed by changing the situation of bringing the side of the elastic portion or the side of the receive portion into contact with the projection by operating to pivot the switch knob.

Therefore, the elastic portion can be brought into a both end holding state and rigidity of the elastic portion per se can be increased. Therefore, the wall thickness of the elastic portion or the like can be reduced and light-weighted formation and small-sized formation can further be expedited. Further, since the rigidity of the elastic portion is increased, a jig pin at the elastic portion is easy to be drawn from a mold and fabrication can be facilitated.

According to the invention of a seventh aspect, in addition to the effect of the invention according to any one of the first to sixth aspects, the fixed contact is fixedly supported by the terminal block attached engageably and detachably to the switch case, the movable piece having the movable contact brought into contact with and separated from the fixed contact is pivotably supported, the slider having the elastic contact member brought into elastic contact with the movable piece and the cooperative engaging portion for engaging the operating lever portion is movably supported, the slider is moved in cooperation with the operating lever portion by operating to pivot the switching knob, and the movable contact can be brought into contact with and separated from the fixed contact by pivoting the movable piece by moving the elastic contact member on the movable piece. In integration, the operating lever portion of the switch knob inserted from the opening of the knob attaching portion is engaged with the cooperative engaging portion of the slider supported by the terminal block and by firmly holding the switch knob at the neutral position relative to the switch case as described above, engagement to the cooperative engaging portion of the operating lever portion can easily be carried out and integration can simply be carried out.

DESCRIPTION OF THE PREFERRED EMBODIMENTS (First Embodiment)

Figure 1:
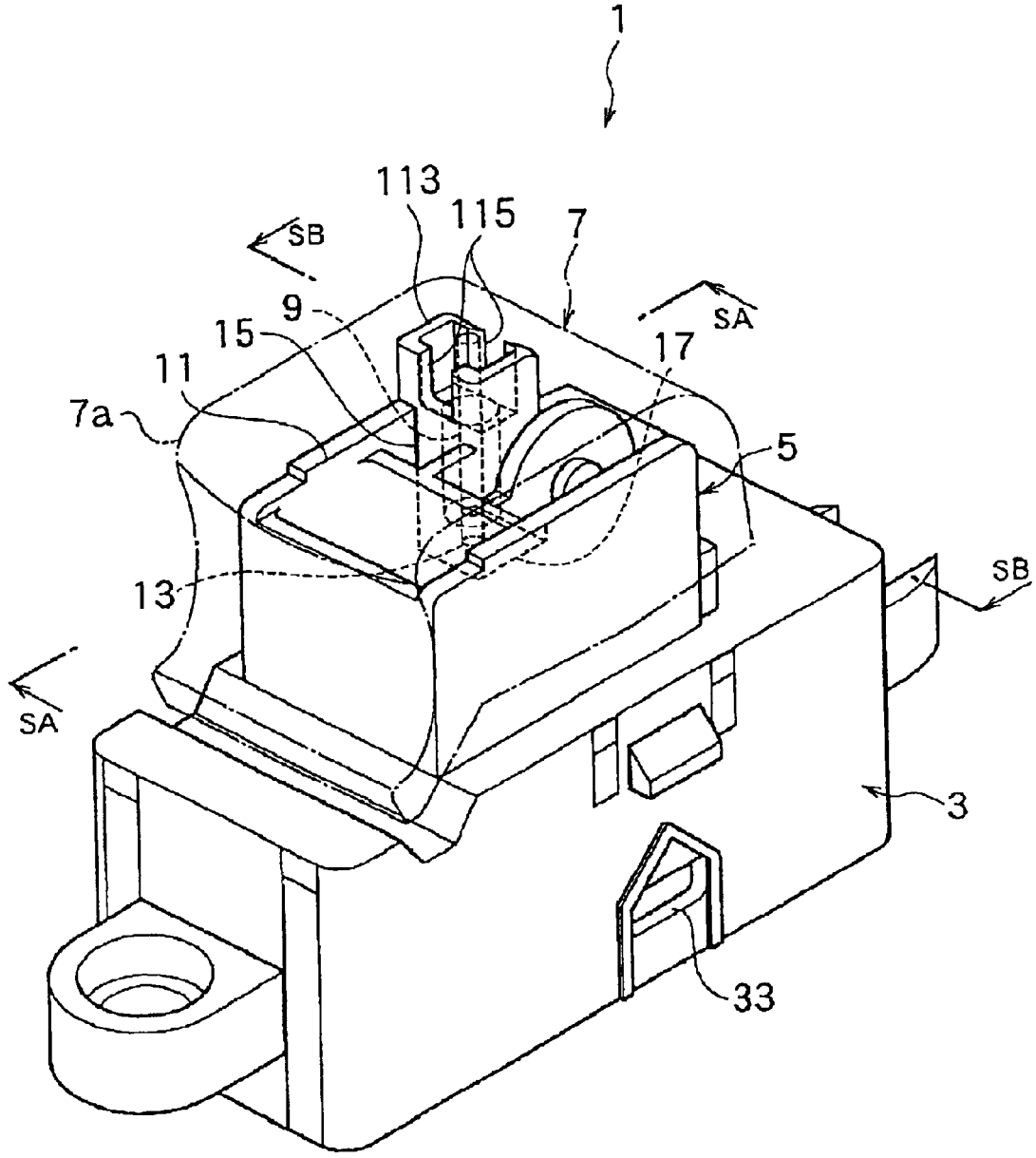
FIG. 1 is a perspective view of a power window switch according to a first embodiment of the invention.

FIG. 1 shows a perspective view of a power window switch 1 for, for example, an automobile as a switch according to a first embodiment of the invention. The power window switch 1 is provided, for example, at a window of a driver seat, a front passenger seat, a rear seat or the like of an automobile. Further, the power window switch 1 is installed at an arm rest of a door or a vehicle compartment side of a door of, for example, a driver seat, a front passenger seat, a rear seat or the like of an automobile. Further, a position and a direction of a respective portion or member, mentioned later, indicates a direction in the attached drawing and upper and lower directions, left and right directions and front and rear directions are changed by the state of attaching the power window switch 1 to an automobile and are not limited to illustration. An explanation will be given of the embodiment with an arbitrary illustrated state of the attached drawing as a reference as follows.

As shown by FIG. 1, according to the power window switch 1, a switch knob 7 is axially supported by a knob attaching portion 5 of a switch case 3 constituting an upper case to be capable of operating pivoting movement.

The switch knob 7 is provided with an elastic pin portion 9 constituting an elastic projection as an elastic portion. The elastic pin portion 9 is for holding a neutral position of the switch knob 7 relative to the switch case 3 by elastic force and providing an operating lever 87 (see FIG. 2) vertically to the switch case 3. According to the embodiment, the elastic pin portion 9 is projected from an upper portion of an inner face of the switch knob 7 into an opening 11 of the knob attaching portion 5. The elastic pin portion 9 is a round bar a total of which is constituted by a taper shape to facilitate to draw a mold when the elastic pin portion 9 is molded by resin by using the mold. Further, a section of the elastic pin portion 9 may be constituted by a polygonal shape.

An engaging hole 13 is provided on a side of the switch case 3 as a receive portion. The engaging hole 13 is for engaging the elastic pin portion 9. The elastic pin portion 9 is fitted to the engaging hole 13 to be capable of moving in the up and down direction such that the elastic pin portion 9 can be operated to bend smoothly when the switch knob 7 is operated. Further, the elastic pin portion 9 may be provided with elastic force capable of supporting the switch knob 7 without play in a state of the neutral position at which the operating lever 87 is made vertical when the switch knob 7 is integrated to an upper side of the switch case 3. The elastic force of the elastic pin portion 9 is set to be as small as about one-tenth of that of a coil spring 77, mentioned later, and the elastic pin portion 9 is formed to be easy to deform to bend and to provide durability. According to the embodiment, the engaging hole 13 is for fittedly holding a front end of the elastic pin portion 9 and is provided at a bottom portion 17 of a spring containing portion 15 of the knob attaching portion 5.

The spring containing portion 15 is constructed by a constitution capable of containing a coil spring used for a switch knob having another specification. As the switch knob having the other specification, there is provided a switch knob of an auto switch having a specification for lifting and lowering power window on the side of the driver seat when, for example, the power window switch 1 is attached to the door on the side of the driver seat.

Figure 2:
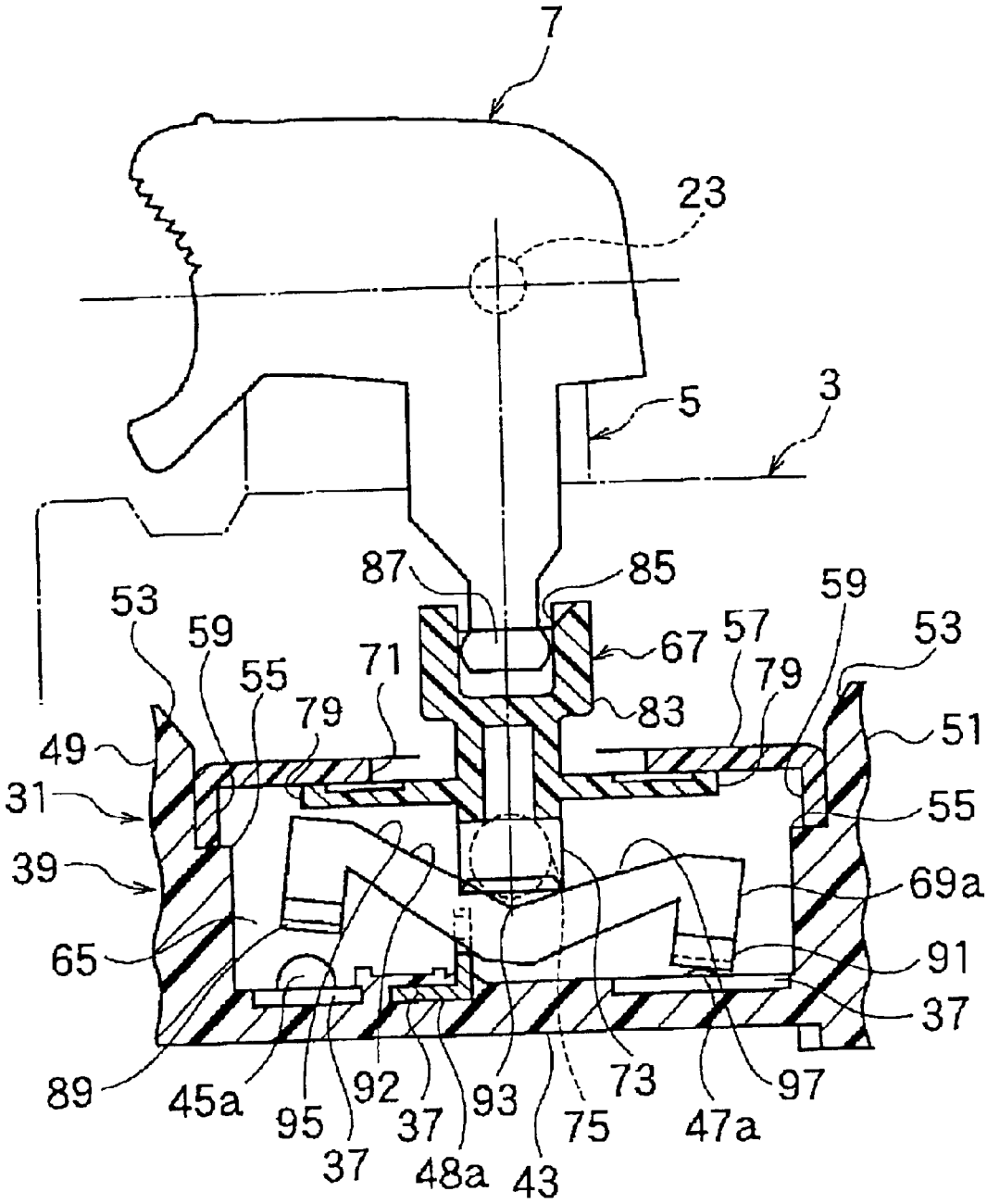
FIG. 2 is a sectional view of essential portions taken along a line SA—SA of FIG. 1 according to the first embodiment.

A further explanation will be given of the power window switch 1 in reference to FIG. 2 and FIG. 3. FIG. 2 is a partial sectional view taken along a line SA—SA of FIG. 1 and FIG. 3 is a sectional view taken along a line SB—SB of FIG. 1.

Figure 3:
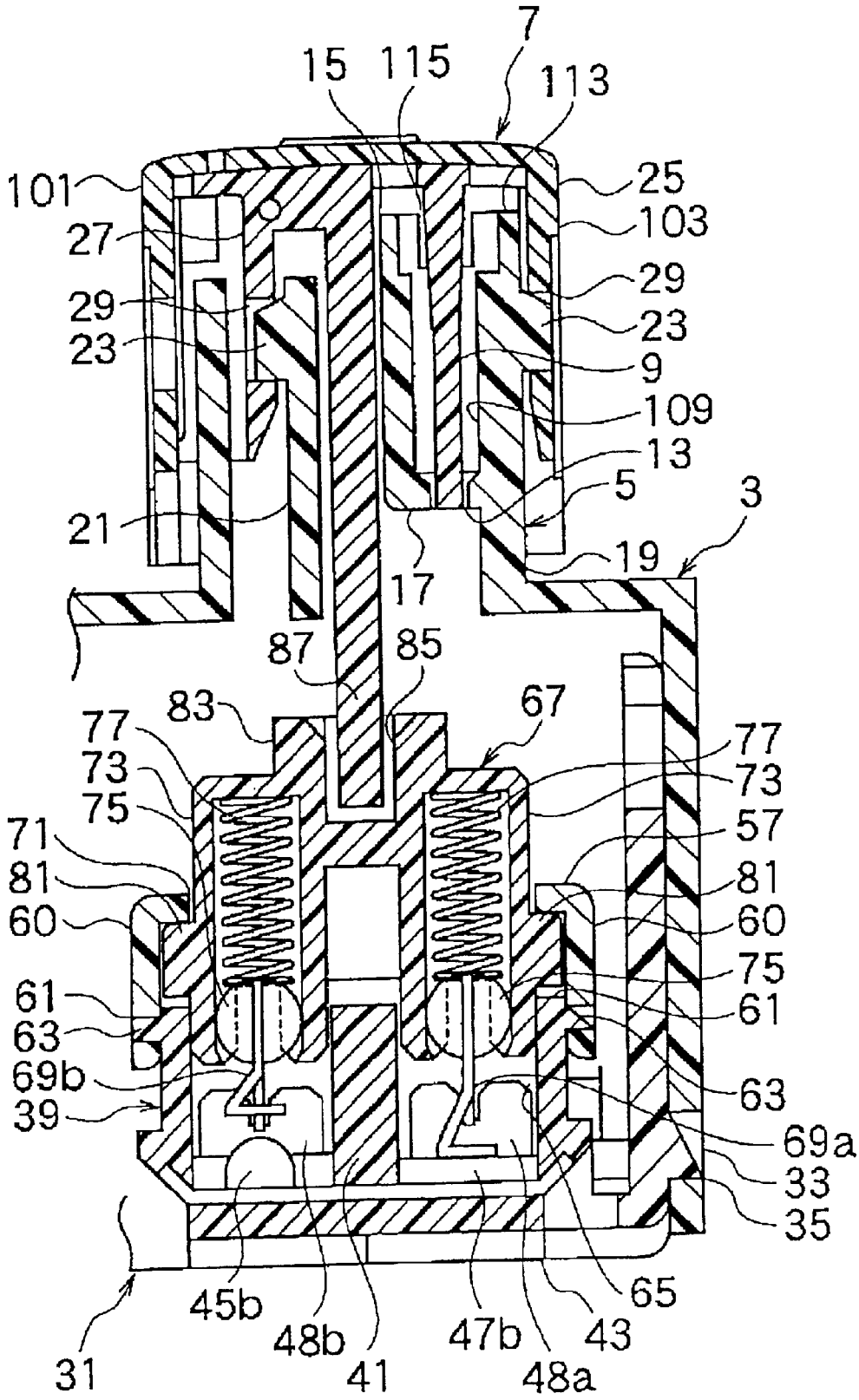
FIG. 3 is a sectional view of essential portions taken along a line SB—SB of FIG. 1 according to the first embodiment.

As shown by FIG. 2 and FIG. 3, according to the knob attaching portion 5, boss portions 23 are projected from a side wall 19 and a middle wall 21. According to the knob 7, fitting holes 29 are provided at a side wall 25 and a middle wall 27. The fitting holes 29 of the switch knob 27 are fitted to the boss portions 23 of the knob attaching portion 5 and the switch knob 7 is axially supported pivotably by the knob attaching portion 5. By the axial support, the switch knob 7 can pivotably be operated relative to the knob attaching portion 5.

The switch case 3 is attachably and detachably attached with a terminal block 31 constituting a lower case. The attachment is carried out by engaging an engaging projection 35 of the terminal block 31 to an engaging window 33 provided at the switch case 3.

The terminal block 31 is insert-molded with a conductive plate 37 conducted to a terminal and a fixed contact by insulating resin. The terminal block 31 is provided with a containing wall portion 39. The containing wall portion 39 is partitioned into left and right portions by a middle wall 41.

On the left side of the middle wall 41 of the containing wall portion 39 (on the left side of the containing wall portion 39 in FIG. 3), a contact for lifting is contained and on the right side, a contact for lowering is contained. Fixed contacts 45*a* and 45*b*, fixed contact portions 47*a* (illustration is omitted for lifting), and fulcrum serving fixed contacts 48*a* and 48*b*, are fixedly supported by a bottom wall 43 of the containing wall portion 39.

Guide walls 49 and 51 are projected upwardly at both of front and rear sides of the containing wall portion 39 (FIG. 2). The guide walls 49 and 51 are inclinedly formed with guide faces 53. Cover support faces 55 are provided on front and rear sides of the containing wall portion 39 on inner sides of the guide walls 49 and 51. There is constituted a structure in which wall portions 59 on front and rear sides of a slider cover 57 are brought into contact with the cover support faces 55.

The slider cover 57 is molded by resin. The slider cover 57 is respectively provided with two pieces of engaging holes 61 at left and right wall portions 60 (FIG. 3). The engaging holes 61 are engaged with engaging claws 63 of the containing wall portion 39. Therefore, the slider cover 57 is attachably and detachably attached to the containing wall portion 39. Thereby, there is formed a containing space 65 between the containing wall portion 39 and the slider cover 5–7. The slider 67 and a movable pieces 69*a* and 69*b* are contained in the containing space 65. The slider cover 57 is provided with a window 71.

The slider 67 is molded by resin and the slider 67 is provided with a pair of left and right ball support portions 73. Steel balls 75 constituting elastic contact members are contained in the ball support portions 73 via coil springs 77 as urge members. The coil spring 77 functions as a click spring, a spring for contact and a spring for automatically returning the switch knob 7 to a neutral position.

The slider 67 is projected with a slider plate portion 79 on a lower face side of the slider cover 57 in the front and rear direction. Slider projections 81 are projected on left and right sides of the slider 67. The slider projection 81 is interposed between the containing wall portion 39 and a lower face of the slider cover 57 to be guided to slide.

The slider 67 is provided with a head portion 83. The head portion 83 is projected from the window 71 of the slider cover 57 to the side of the switch knob 7 along with upper sides of the ball support portions 73. The head portion 83 is provided with an operating recessed portion 85 constituting a cooperative engaging portion. The operating lever 87 of the switch knob 7 is fitted to the operating recessed portion 85. The lower end of the operating lever 87 is formed substantially in a circular shape to facilitate its insertion into the operating recessed portion 85 and such that the operation lever 87 can be pivoted.

The movable piece 69*a* is pivotably supported by the fulcrum serving fixed contact 48*a* and the movable piece 69*b* is pivotably supported by the fulcrum serving fixed contact 48*b*. The movable pieces 69*a* and 69*b* are formed by pressing a plate member of a conductive metal. A movable contact 89 is provided on one side in the front and rear direction of the movable piece 69*a* and a movable contact portion 91 is provided on other side thereof. The movable contact 89 is constructed by a constitution of being brought into contact with and separated from the fixed contact 45*a* by pivoting the movable piece 69*a*. Such a structure is similar also on the side of the movable piece 69*b* installed along with the movable piece 69*a*. However, in order to carry out lifting and lowering operation, on the side of the movable piece 69*b*, a relationship of arranging the movable contact 89 and the fixed contact 45*b* and the movable contact portion and the fixed contact portion, is reversed and in view of the state of FIG. 2, the movable contact and the fixed contact are disposed on the right side and the movable contact portion and the fixed contact portion are disposed on the left side.

Click grooves 92 are provided at end edges of the movable pieces 69*a* and 69*b*. The click groove 92 is a click face for giving a click in elastic contact, movement of the steel ball 75, providing a click feeling to operation of the switch knob 7 and automatically returning the movable pieces 69*a* and 69*b*, the slider 67 and the switching knob 7 to the neutral position by bringing the steel ball 75 into press contact therewith. The click groove 92 is formed by an inclined face 93 cut in a V-like shape at center thereof and inclined faces 95 and 97 having slightly gradual inclinations frontward and rearward therefrom. The respective steel balls 75 of the slider 67 are constructed by a constitution of pivoting the movable pieces 69*a* and 69*b* by moving on the click grooves 92 of the movable pieces 69*a* and 69*b* to thereby bring the respective movable contacts 89 into contact with the fixed contacts 45*a* and 45*b* and separating the respective movable contacts 89 therefrom.

A further explanation will be given here of details of a neutral holding structure constituting a characteristic of the invention also in reference to FIG. 4 through FIG. 12.

Figure 4:
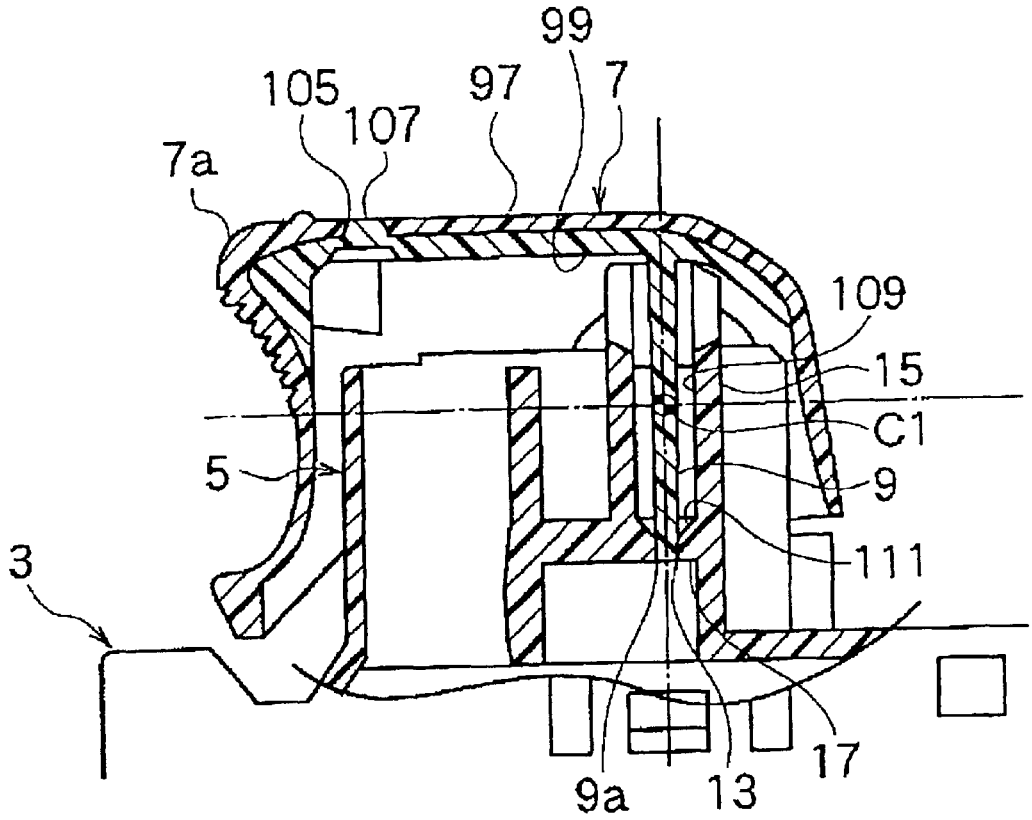
FIG. 4 is a sectional view of essential portions at a periphery of a switch knob taken along the line SA—SA of FIG. 1 according to the first embodiment.
Figure 5:
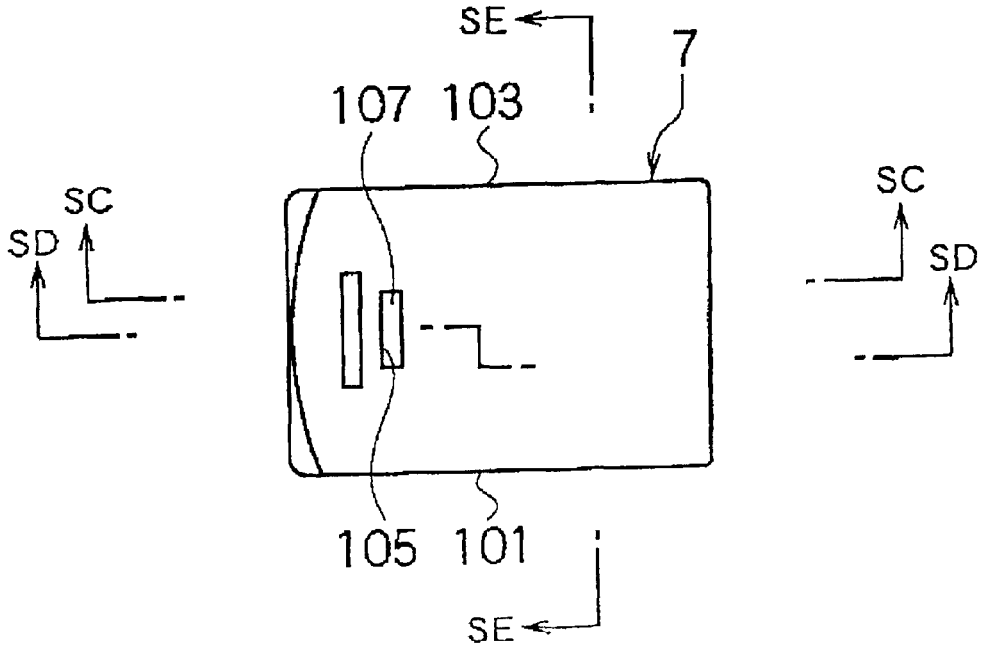
FIG. 5 is a plane view of the switch knob according to the first embodiment.
Figure 6:
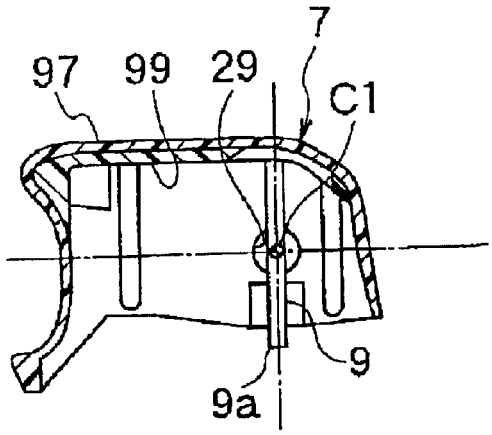
FIG. 6 is a sectional view taken along a line SC—SC of FIG. 5 according to the first embodiment.
Figure 7:
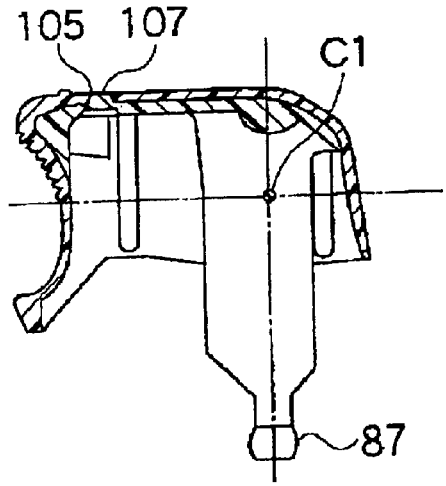
FIG. 7 is a sectional view taken along a line SD—SD of FIG. 5 according to the first embodiment.
Figure 8:
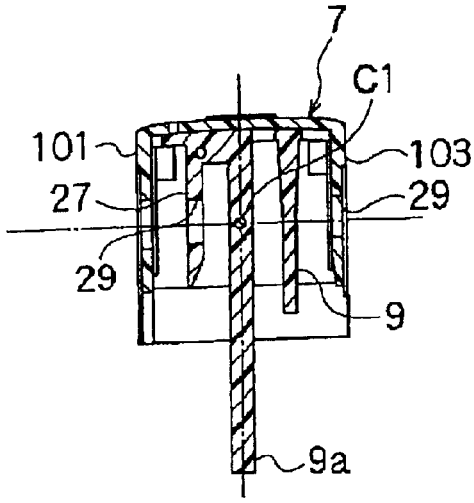
FIG. 8 is a sectional view taken along a line SE—SE of FIG. 5 according to the first embodiment.
Figure 9:
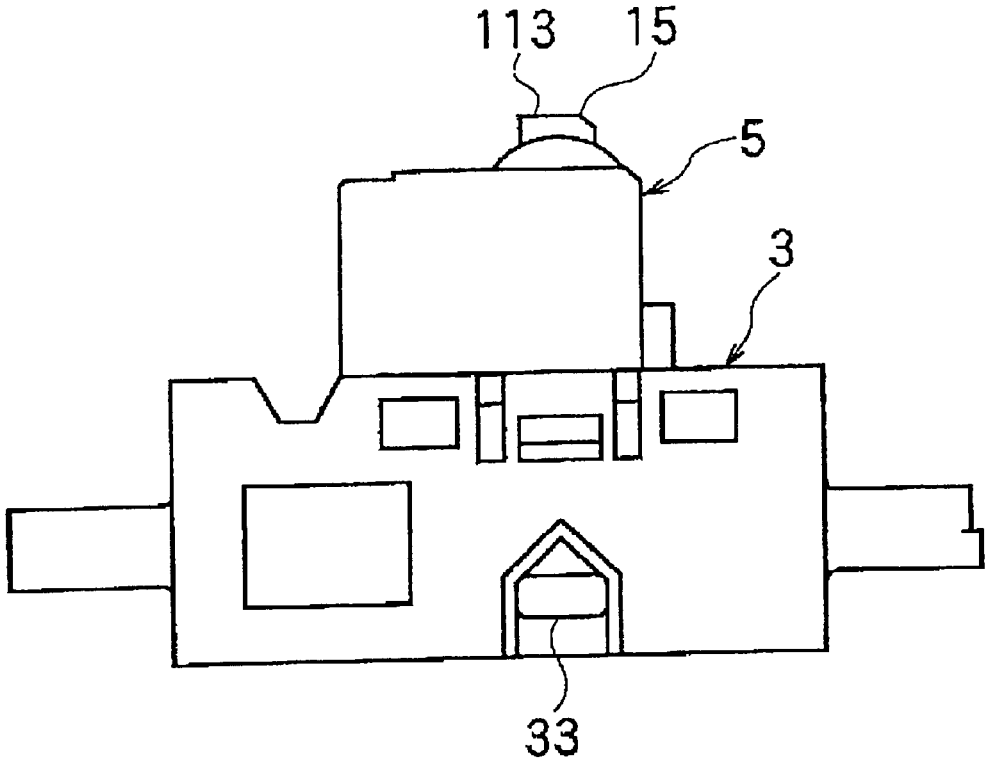
FIG. 9 is a side view of a switch case according to the first embodiment.
Figure 10:
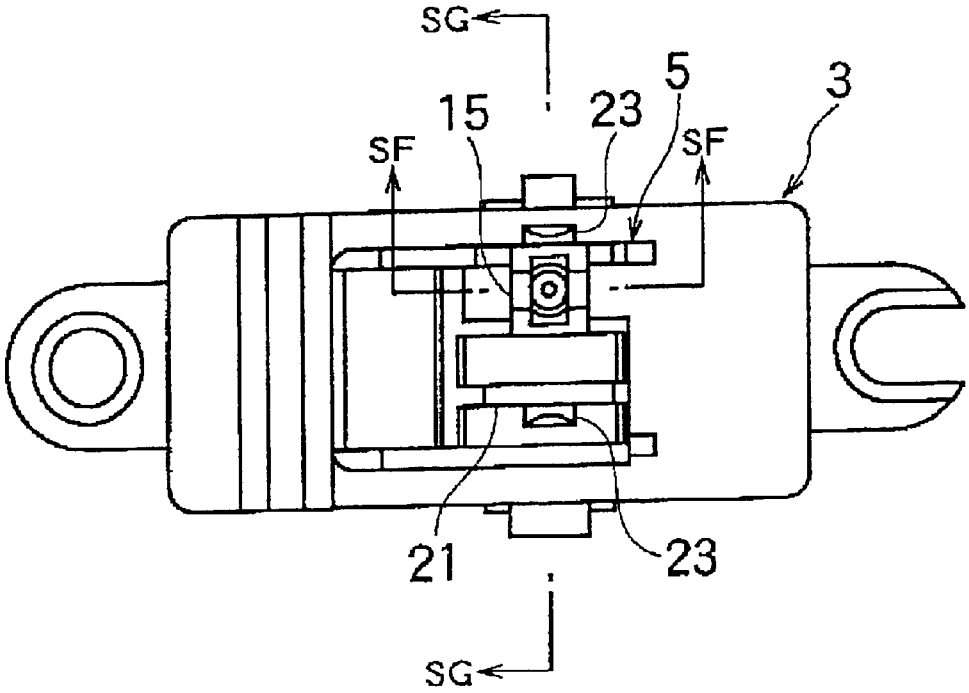
FIG. 10 is a plane view of the switch case according to the first embodiment.
Figure 11:
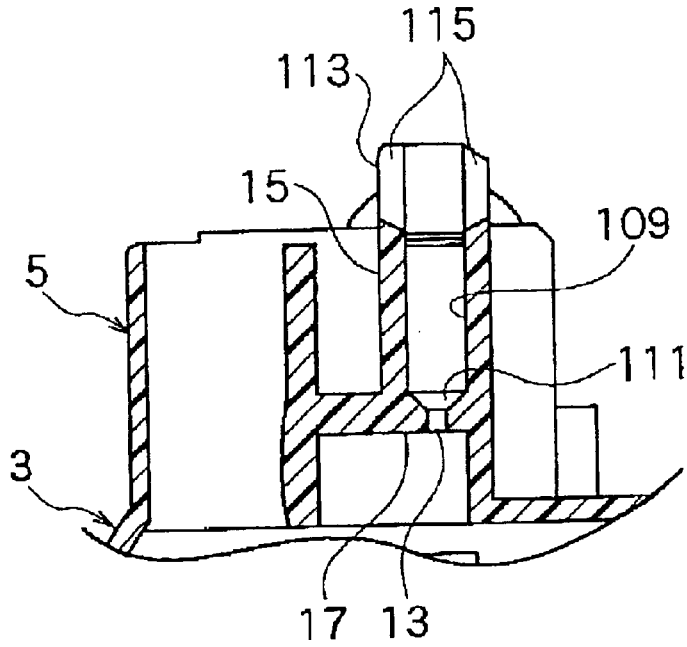
FIG. 11 is a sectional view of essential portions taken along a line SF—SF of FIG. 10 according to the first embodiment.
Figure 12:
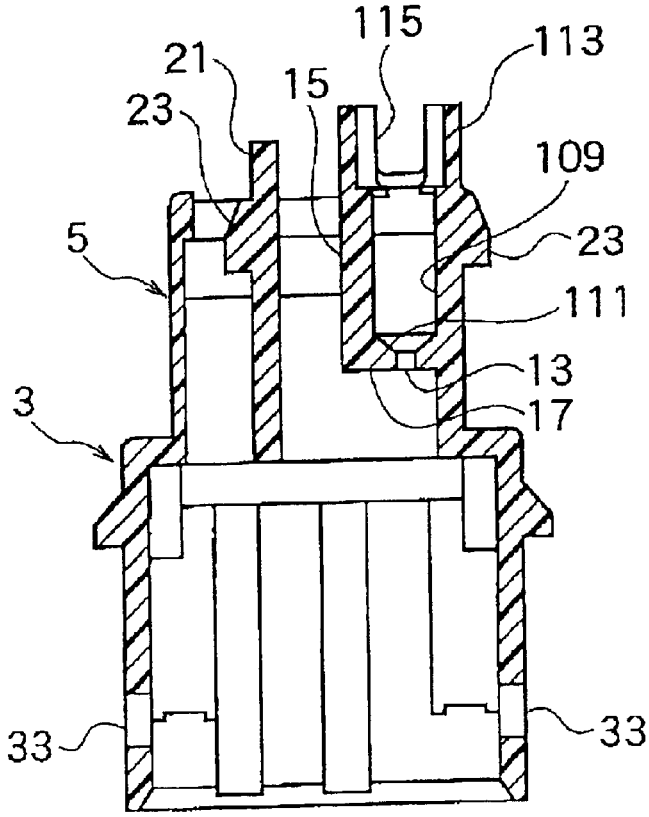
FIG. 12 is a sectional view taken along a line SG—SG of FIG. 10 according to the first embodiment.

FIG. 4 is a sectional view showing a periphery of the switch knob taken along the line SA—SA of FIG. 1 along with the switch case, FIG. 5 is a plane view of the switch knob, FIG. 6 is a sectional view taken along a line SC—SC of FIG. 5, FIG. 7 is a sectional view taken along a line SD—SD of FIG. 5, FIG. 8 is a sectional view taken along a line SE—SE of FIG. 5, FIG. 9 is a side view of the switch case, FIG. 10 is a plane view of the switch case, FIG. 11 is a sectional view of essential portions taken along a line SF—SF of FIG. 10 and FIG. 12 is a sectional view taken along a line SG—SG of FIG. 10.

First, as shown by FIG. 4, the switch knob 7 is axially supported by the bosses 23 pivotably relative to the knob attaching portion 5 and an axis line of the elastic pin portion 9 passes a pivoting center C1 of the switch knob 7. Therefore, elastic recovery force of the elastic pin portion 9 can be exerted as a moment around the pivoting center C1, the operating lever 87 can be integrated to be vertical to the switch case 3 and the switch knob 7 can firmly and smoothly be returned to the neutral position. Further, the pivoting center C1 intersects with substantially the center in the length direction of the elastic pin portion 9 and therefore, elastic force of the elastic pin portion 9 can sufficiently be utilized for holding the neutral position of the switch knob 7.

When such a switch knob 7 is viewed as a single member, the switch knob 7 is as shown by FIG. 5 through FIG. 8. The switch knob 7 is constituted by a two-layered structure of an outer layer portion 97 and an inner layer portion 99. The outer layer portion 97 is molded by, for example, ABS resin and the inner layer portion 97 is molded by, for example, polycarbonate (PC). The outer layer 98 is provided with left and right side walls 101 and 103 and an opening 105 for display. The inner layer portion 99 is integrally provided with the operating lever portion 87, the elastic pin portion 9 and the middle wall 27. Further, the inner layer portion 99 is provided with a projection 107, which is disposed at inside of the opening 105 of the outer layer portion 97 to constitute a light projecting display portion. That is, the inner layer portion 99 is provided with light transmitting performance for transmitting light of a light emitting diode or a lamp provided at an inner portion of the switch to thereby carry out predetermined display.

The side walls 101 and 103, the middle wall 27, the operating lever portion 87 and the elastic pin portion 9 are arranged substantially at equal intervals in view from the section of FIG. 8. Further, the axis center of the elastic pin portion 9 passes the center of the support hole 29 of the knob attaching portion 5 fitted to the support pin 23 of the knob attaching portion 5 in view from the state of FIG. 6.

Next, when the side of the switch case 3 is viewed as a single member, the switch case 3 is as shown by FIG. 9 through FIG. 12. The spring containing portion 15 is provided with a spring containing hole 109 having an inner diameter larger than a diameter of the elastic pin portion 9 to facilitate to deform to bend the elastic pin portion 9 and supporting the elastic pin portion 9 in a loose fit state. The bottom portion 17 of the spring containing portion 15 is formed as a guide portion 111 in a shape of a taper hole converging from the spring containing hole 109 to the engaging hole 13. A fitting portion 113 is provided at an upper end of the spring containing portion 15. The fitting portion 113 is provided with a fitting groove 115 communicated in the front and rear direction of the direction of pivoting the switch knob 7. The fitting groove 115 is for loosely fitting a click portion, mentioned later, of a switch knob having other specification and avoiding interference with the click portion.

In integrating operation, in a state in which the side of the switch case 3 and the side of the terminal block 31 are separated, on the side of the switch case 3, the switch knob 7 is pivotably supported and on the side of the terminal block 31, the movable pieces 69*a* and 69*b* are pivotably supported by the fulcrum serving fixed contacts 48*a* and 48*b* and the slider 67 and the like are integrated.

The steel ball 75 is contained in the slider 67 previously via the coil spring 77 and the slider 67 and the slider cover 57 are arranged above the containing wall portion 39 in a state in which the side of the head portion 83 is projected from the window 71 of the slider cover 57. When the slider cover 57 is pushed onto the containing wall portion 39 via the guide of the guide face 53, the engaging hole 61 of the slider cover 57 is engaged with the engaging claw 63 of the terminal block 31. Under the state, the steel balls 75 of the slider 67 are brought into elastic contact with the movable pieces 69*a* and 69*b* and arranged in the state of the neutral position (OFF position) by the inclined faces 95 and 97 to thereby previously attach the slider 67 and the like to the side of the terminal block 31.

In attaching the switch knob 7, firstly, the elastic pin portion 9 is arranged to be opposed to the spring containing portion 15. Successively, the switch knob 7 is pushed to the knob attaching portion 5. By the pushing the elastic pin portion 9 is inserted into the spring containing hole 109 of the spring containing portion 15 and a front end 9*a* thereof is fitted to the engaging hole 13 at the bottom portion 17 of the spring containing portion 15. Although the fitting of the front end 9*a* to the engaging hole 13, is constituted by loose fitting having a small clearance, it is naturally possible to provide the engaging pin portion 9 at the pivoting center C1 and form the engaging pin portion 9 by a constitution easy to deform elastically to thereby constitute fitting which is not provided with a clearance or press-fitting.

In inserting the elastic pin portion 9, even when a relationship between the front end 9*a* of the elastic pin portion 9 and the engaging hole 13 is more or less shifted, by bringing the front end 9*a* of the elastic pin portion 9 into contact with the guide portion 111 at the lower end of the spring containing hole 109, the front end 9*a* is automatically guided to the side of the engaging hole 13 and the front end 9*a* of the elastic pin portion 9, can firmly be fitted to the engaging hole 13. Therefore, the elastic pin portion 9 can be inserted with the spring containing hole 109 having the large diameter as a measure and the switch knob 7 can be integrated extremely easily.

When the elastic pin portion 9 is fitted to and supported by the engaging hole 13, ride over of inclined faces among the support pin 23, the middle wall 27 and the side wall portion 103, is finished and the support holes 29 of the switch knob 7 are fitted to the support pins 23 of the knob attaching portion 5 as shown by FIG. 3.

By attaching the switch knob 7 to the knob attaching portion 5 in this way, as described above, the front end 9*a* of the elastic pin portion 9 is fitted to and held by the engaging hole 13, the switch knob 7 is held at the neutral position relative to the knob attaching portion 5 and the operating lever 87 is hung right downwardly. Further, the movable piece 69*a* and the slider 67 attached as described above, are disposed at the neutral position (OFF position) by spring force of the coil spring 77. Therefore, when the switch case 3 and the terminal block 31 are coupled and the engaging projection 35 is engaged with the engaging window 33, the operating lever portion 87 of the switch knob 7 is automatically fitted into the operating recessed portion 85 of the slider 67. The fitting is automatically carried out mainly by the switch lever 7 held at the neutral position as described above, relative to the slider 67 similarly held at the neutral position although the fitting is guided also by a curved face at the front end of the operating lever portion 87, a guide inclined face provided at an entry portion of the operating recessed portion 85 and the like, and the integration can smoothly be carried out even when there is brought about a state in which portions of the operating lever portion 87 and the operating recessed portion 85 are disposed at inside of the switch case 3 and are not seen in integration.

Next, a description will be given of switching operation. When the power window is lifted by the switch knob 7, an operating portion 7*a* of the switch knob 7 is pulled up and the switch knob 7 is rotated in the clockwise direction in FIG. 2. Thereby, the operating lever portion 87 transmits operational force to the operating recessed portion 85 and the slider 67 is moved in the left direction in FIG. 2. In the operation, the switch knob 7 is pivoted centering on the pivoting center C1 by the axial support of the support pin 23. At this occasion, the elastic pin portion 9 is bent at inside of the spring containing hole 109 and pivoting of the switch knob 7 centering on the support pin 23 can be permitted. Further, in operating the switch knob 7, the elastic pin portion 9 can provide predetermined elastic force and therefore, in rotating the switch knob 7 centering on the support pin 23, play of the switch knob 7 can be prevented.

By the operation of pulling up the switch knob 7, the steel ball 75 is shifted from the inclined face 93 to the inclined face 95 in the click groove 92 and the movable piece 69*a* is pivoted in the counterclockwise direction of FIG. 2 centering on the fulcrum serving fixed contact 48*a*. By the pivoting, the movable contact 89 is brought into contact with the fixed contact 45*a*, there is constituted a closed circuit of the fixed contact 45*a*, the movable contact 89, the movable piece 69*a* and the fulcrum serving fixed contact 48*a* and the power window can be lifted.

When the hand is separated from the switch knob 7, the switch knob 7 is urged by the elastic recovery force of the elastic pin portion 9 and the spring force of the coil spring 77, rotated to return centering on the support pin 23 and is held at the neutral position again. At the neutral position, the elastic pin portion 9 can exert elastic reactive force to movement of the switch knob 7 and therefore, the switch knob 7 can firmly be held at the neutral position and the play of the switch knob 7 relative to portions thereof connected to the knob attaching portion 5 and the operating recessed portion 85 can firmly be prevented.

On the side of the terminal block 31, by the urge force of the coil spring 77, the steel ball 75 is automatically returned from the inclined face 95 to the inclined face 93. By the returning, there is brought about a state in which the movable contact 89 is separated from the fixed contact 45*a* as shown by FIG. 2 by operation reverse to the above-described and there is brought about a state in which the movable contact portion 91 is brought into contact with the fixed contact portion 47*a*. The state can firmly be maintained by bringing the steel ball 75 into the inclined face 93 having a large inclination.

When the power window is lowered, the operating portion 7*a* of the switch knob 7 is pressed to thereby rotate the switch knob 7 in the counterclockwise direction in the state of FIG. 2. At this occasion, similar to the above-described, by bending the elastic pin portion 9 and cooperatively moving the slider 67 and the movable piece 69*a* by the switch knob 7 against the coil spring 77, rotation of the switch knob 7 is permitted.

The slider 67 is moved in the right direction in FIG. 2 and the steel ball 75 is moved from the inclined face 93 to the inclined face 97 on the side of the movable contact portion 91. By the movement, there is maintained a state in which the movable contact portion 91 is brought into contact with the fixed contact portion 47*a*, that is, the movable piece 69*a* maintains the state of FIG. 2. Under the state, on the side of the movable piece 69*b*, the movable piece 69*b* is moved reverse to the movable piece 69*a*, the movable contact 89 of the movable piece 69*b* is brought into contact with the fixed contact 45*b*, a closed circuit is formed similar to the above-described and the power window can be lowered.

Further, when the hand is separated from the switch knob 7, similar to the above-described, the switch knob 7 automatically returns to the neutral position by the elastic recovery force of the coil spring 77 and the elastic pin portion 9 and the neutral position is maintained in a state of preventing play. The movable pieces 69*a* and the 69*b* also return to the neutral position similar to the above-described.

Further, according to the above-described embodiment, integration can be carried out only by fitting the front end 9*a* of the elastic pin portion 9 to the engaging hole 13 since an elastic portion is constituted by the elastic pin portion 9 and a receive portion is constituted by the engaging hole 13, a number of parts can be reduced and a number of integrating steps can significantly be reduced. Further, the elastic pin portion 9 is only engaged with the engaging hole 13 and therefore, a failure in step in integration can considerably be restrained. Further, since the number of parts is small, integration and parts control can be facilitated and a considerable reduction in cost can be achieved.

According to the embodiment of the invention, the spring containing portion 15 can contain a coil spring used in a switch knob having other specification and therefore, in place of the switch knob 7, a switch knob 7A of an auto switch can be mounted as shown by FIG. 13.

Figure 13A:
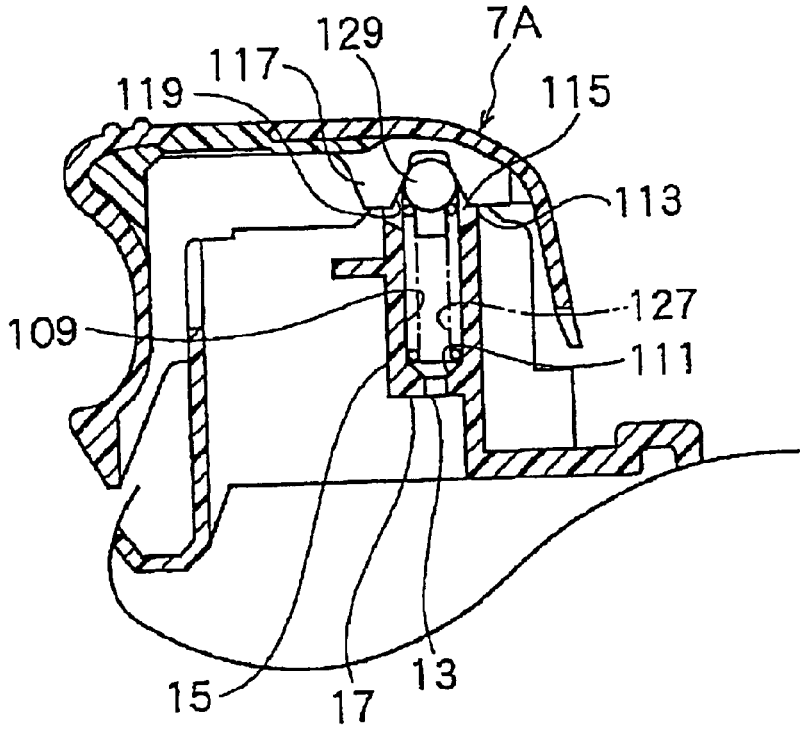
FIG. 13A is a sectional view at a periphery of a switch knob in a state in which an auto switch is attached to a knob attaching portion.
Figure 13B:
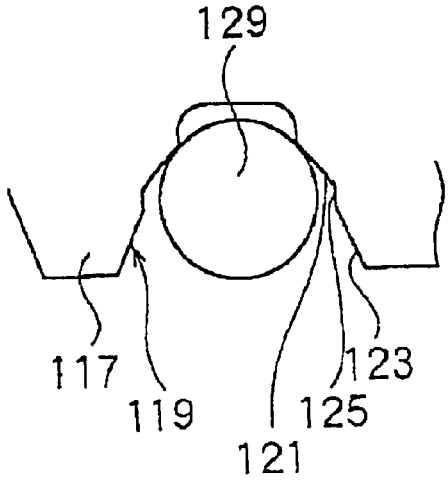
FIG. 13B is an enlarged view of a periphery of a click portion according to the first embodiment.

FIG. 13A is a sectional view of essential portions at a periphery of a switch knob and FIG. 13B is an enlarged view of a periphery of a click portion. The auto switch is used when a power window switch on, for example, a driver seat side is operated to lift and lower and a constitution other than the switch knob 7A is similar to that as described above.

The switch knob 7A is provided with a click portion 117 above the spring containing portion 15. The click portion 117 is provided with a click groove 119. The click groove 119 is formed in two stages symmetrically in the front and rear direction and is constituted by front and rear inclined faces 121 for manual operation, front and rear inclined faces 123 for automatic operation and partition faces 125 between the inclined faces 121 and 123.

The click portion 117 is fitted to the notched portion 115 at an upper end of the spring containing portion 15. There is constructed a constitution in which a coil spring 127 is contained in the spring containing hole 109 and a roller 129 urged by the coil spring 127 is brought into contact with the click groove 119.

In switching operation, when the switch knob 7A is rotated by operating to pull up or press the operating portion 7*a* of the switch knob 7A, in a range of a first stage of manual operation, the inclined faces 121 of the click portion 117 are slid relative to the roller 129. When the partition faces 125 is brought into contact with the roller 129 by the sliding, predetermined reactive force is given to rotation of the switch knob 7A and finish of the manual operation region can be informed to the driver. Therefore, the driver can operate to lift and lower the power window manually by operating to press and pull up the switch knob 7A by predetermined operational force.

When the switch knob 7A is pulled up or pressed to a second stage by force equal to or larger than the predetermined operational force, the roller 129 rides over the partition faces 125 and the inclined faces 123 are brought into sliding contact with the roller 129. Therefore, the power window on the driver seat side can automatically be lifted and lowered only by operating to pull up or press the switch knob 7A once up to the region of the second stage.

In operating such a switch knob 7A, since the click portion 117 is fitted to the notched portion 115, front and rear portions of the roller 129 are surrounded by the click groove 119, left and right portions thereof are surrounded by the fitting portion 113 and therefore, detachment of the roller 129 can firmly be prevented and operation of the switch knob 7A can smoothly be carried out.

Further, in this way, in the case of the power window switch on the driver seat side, the auto switch as shown by FIG. 13 can be attached and in the case of a power window switch on the front passenger seat side or the rear seat side, the switch knob 7 provided with the elastic pin portion 9 in FIG. 1 and the like can be attached and common use formation of the switch case 3 and the like can be achieved. Therefore, as a whole, a number of parts is considerably reduced, parts control is reduced and a considerable reduction in cost can be achieved.

Further, in the above-described embodiment, a lower end of the spring containing hole 109 can also be made flat by omitting the guide portion 111. Further, there can also be constructed a constitution in which the spring containing portion 15 and the like are omitted, only the engaging hole 13 is provided at the knob attaching portion 5 and the elastic pin portion 9 is fitted to the engaging hole 13. The elastic portion can be formed in a shape of a plate regardless of the elastic pin portion 9. The receive portion can be constituted by a groove or the like for engaging the front end 9*a* of the elastic pin portion 9 or a front end of an elastic portion in a shape of a plate in the front and rear direction in the direction of pivoting the switch knob 7 regardless of the engaging holes 13. The elastic pin portion 9 can also be provided by shifting from the pivoting center C1 by being arranged to the engaging hole 13 to be able to move in the up and down direction.

Further, although according to the embodiment, the elastic pin portion 9 constituting an elastic projection is provided at the switch knob 7 as the elastic portion and the engaging hole 13 constituting the receive portion is provided on the side of the switch case 3, there can be constructed also a constitution in which the engaging hole 13 is provided on the side of the switch knob 7 and the elastic pin portion 9 is provided on the side of the switch case 3.

(Second Embodiment)

Figure 14:
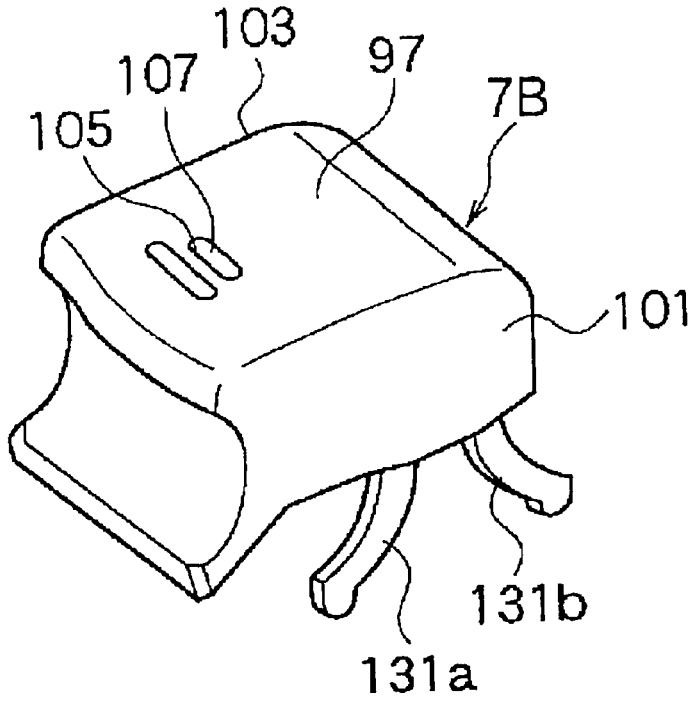
FIG. 14 is a perspective view of a switch knob according to a second embodiment of the invention.
Figure 15:
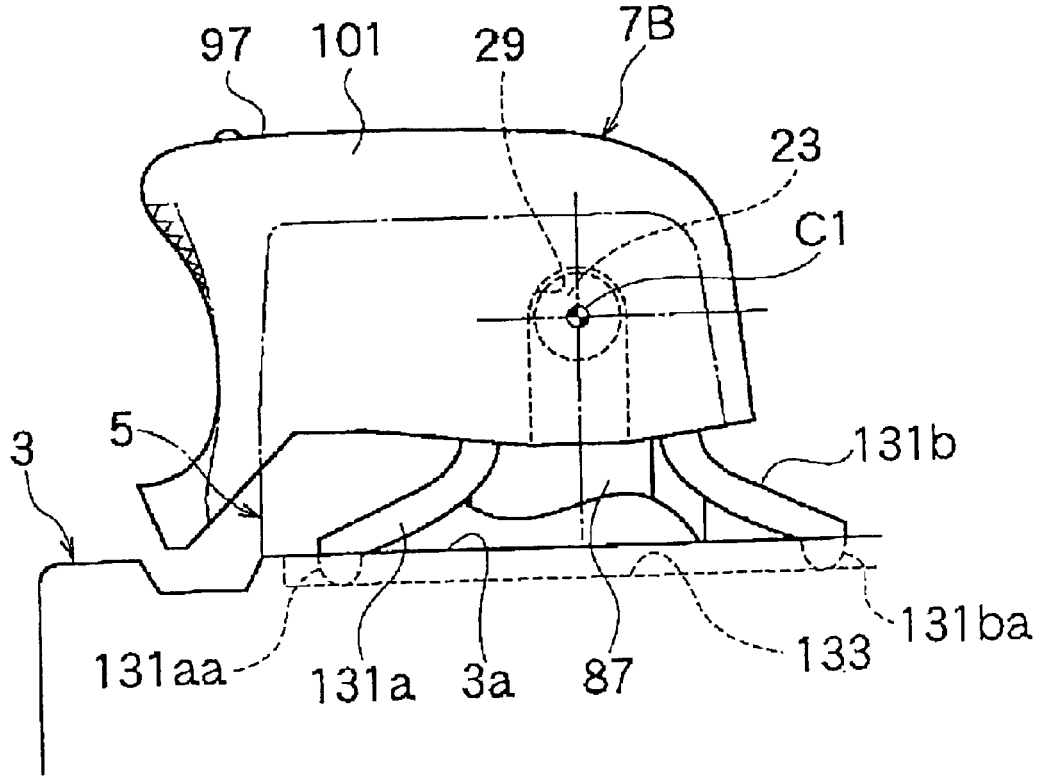
FIG. 15 is a side view of essential portions in a state in which the switch knob is attached to a switch case according to the second embodiment.
Figure 16:
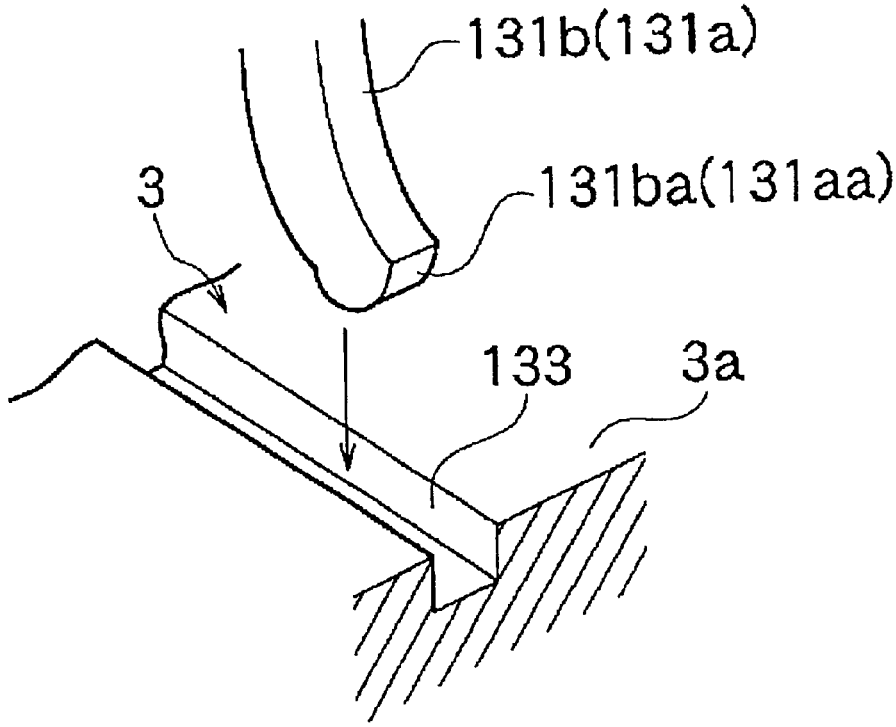
FIG. 16 is a disassembled perspective view of essential portions according to the second embodiment.

FIG. 14 through FIG. 16 show a second embodiment of the invention. FIG. 14 is a perspective view of a switch knob 7B according to a second embodiment, FIG. 15 is a side view of essential portions in a state in which the switch knob 7B is attached to the switch case 3 and FIG. 16 is a disassembled perspective view of essential portions. A total constitution thereof is provided with a structure similar to that of the first embodiment. That is, although not illustrated, there is provided a terminal block having a similar structure. Further, an explanation will be given by attaching the same notations to corresponding constituent portions.

According to the embodiment, there is constructed a constitution in which elastic leg portions 131*a* and 131*b* are provided as an elastic portion, a receive portion is constituted by an outer face 3*a* of the switch case 3 and the elastic leg portions 131*a* and 131*b* are brought into elastic contact with the outer face 3*a* of the switch case 3.

The elastic leg portions 131*a* and 131*b* are integrally provided with the outer layer 98 of the switch knob 7B and is molded by ABS resin. A pair of the elastic leg portions 131*a* and 131*b* in the front and rear direction are provided at each of the side wall portions 101 and 103 of the switch knob 7B. The respective elastic leg portions 131*a* and 131*b* are symmetrically provided in the front and rear direction of the direction of pivoting by constituting a boundary right below the pivoting center C1 constituted by fitting the support pin 23 to the support hole 29. There can also be constructed a constitution in which the elastic leg portions 131*a* and 131*b* are provided only at either one of the side wall portions 101 and 103 of the switch knob 7B. The elastic leg portions 131*a* and 131*b* are formed in a diverging shape in view from sides thereof to open from each other toward the outer face 3*a* of the switch case 3. Projections 131*aa* and 131*ba* are provided at front ends of the elastic leg portions 131*a* and 131*b*.

According to the embodiment, a groove 133 is provided at the outer face 3*a* of the case 3. The groove 133 is provided along the direction of pivoting the switch knob 7B at both side portions of the side wall portions 101 and 103 of the switch knob 7B. The groove 133 is fitted with and guides the projected portions 131*aa* and 131*ba* of the elastic leg portions 131*a* and 131*b*. That is, there is constructed a constitution in which a width of the groove 133 is formed to be slightly wider than a thickness of the elastic leg portions 131*a* and 131*b* to thereby loosely fit and slidably hold the projections 131*aa* and 131*ba* of the elastic leg portions 131*a* and 131*b*.

Further, according to the embodiment, in the switch knob 7B, when the support hole 29 of the switch knob 7B is fitted to the support pin 23 of the knob attaching portion 5, the respective elastic leg portions 131*a* and 131*b* are fitted into the grove 133. Under the state, the elastic leg portions 131*a* and 131*b* are brought into a state in which the projections 131*aa* and 131*ba* are brought into elastic contact with the bottom portion of the groove 133 and are slightly bent.

Therefore, the switch knob 7B can be integrated to the switch case 3 in a state in which the switch knob 7B is held at the neutral position around the pivoting center C1 and the operating lever is made vertical. Further, according to the embodiment, the respective elastic leg portions 131*a* and 131*b* exert also elastic reactive force in the upper direction to the switch knob 7B and therefore, the elastic reactive force can be operated between the boss 23 and the support hole 29 and play of the switch knob 7B can be prevented further firmly.

In operating the switch knob 7B, when the switch knob 7B is pulled up, the elastic leg portion 131*b* is mainly bent and when the switch knob 7B is pressed, the elastic leg portion 131*a* is mainly bent to thereby exert the elastic reactive force. Therefore, when the hand is separated from the switch knob 7B, the switch knob 7B can firmly be returned to the neutral state by urging of the elastic reactive force of the coil spring and the elastic leg portion 131*a* or 131*b*.

In operating the switch knob 7B, the projections 131*aa* and 131*ba* of the elastic leg portions 131*a* and 131*b* are fitted to and guided by the groove 133 and operation by the elastic leg portions 131*a* and 131*b* can firmly be carried out.

In integrating operation, by fitting the projections 131*aa* and 131*ba* of the elastic leg portions 131*a* and 131*b* to the groove 133, there can be avoided an inconvenience in which the finger of the operator or the like is caught by the elastic leg portions 131*a* and 131*b*, destruction of the elastic leg portions 131*a* and 131*b* can be prevented and the function can firmly be achieved.

In this way, also according to the embodiment, operation and effect substantially similar to those of the first embodiment can be achieved. Further, according to the embodiment, the elastic reactive force in the upper direction can be provided to the switch knob 7B by the elastic leg portions 131*a* and 131*b* and the switch knob 7B can be held at the neutral state and play can be prevented further firmly.

Further, by canceling elastic force of the elastic leg portions 131*a* and 131*b* frontward and rearward from the pivoting center C1, an increase in force of operating the switch knob 7B can be restrained.

Further, although according to the second embodiment, the elastic leg portions 131*a* and 131*b* are provided on the side of the switch knob 7B as the elastic portion and the outer face 3*a* is provided on the side of the switch case 3 as the receive portion, there can be constructed also a constitution in which the elastic leg portions 131*a* and 131*b* are provided on the side of the switch case 3 and the outer face 3*a* is provided on the side of the switch knob 7B.

Further, in the above-described embodiment, there can also be constructed a constitution in which the groove 133 is omitted and the elastic leg portions 131*a* and 131*b* are directly brought into contact with the outer face 3*a* of the switch case 3.

Figure 17:
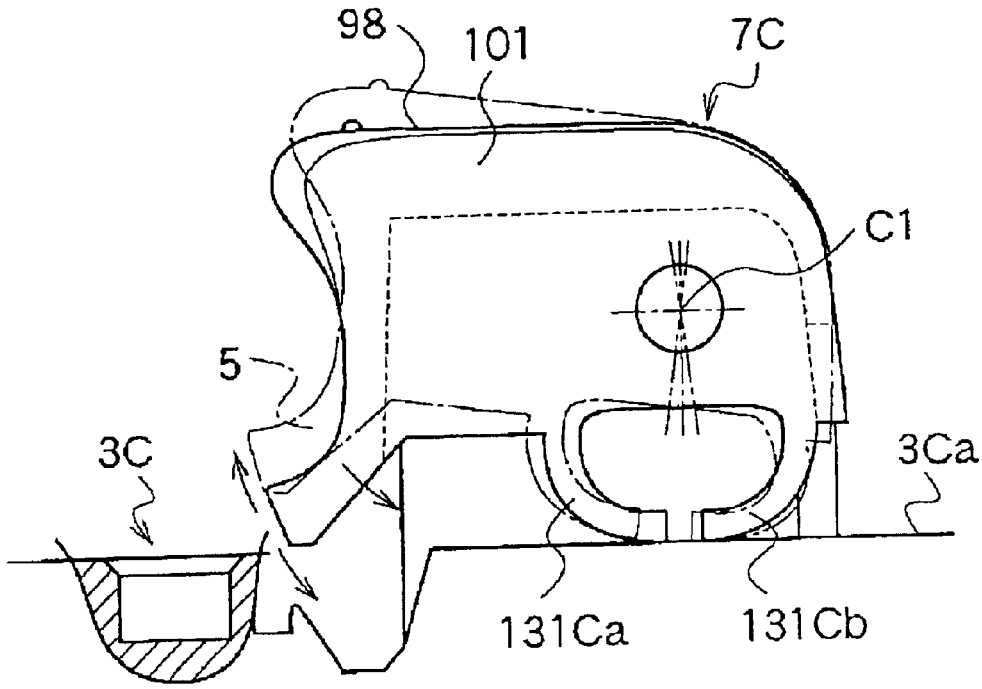
FIG. 17 is a side view of essential portions in which a switch knob is attached to a switch case according to an embodiment of a modified example of the second embodiment.
Figure 18:
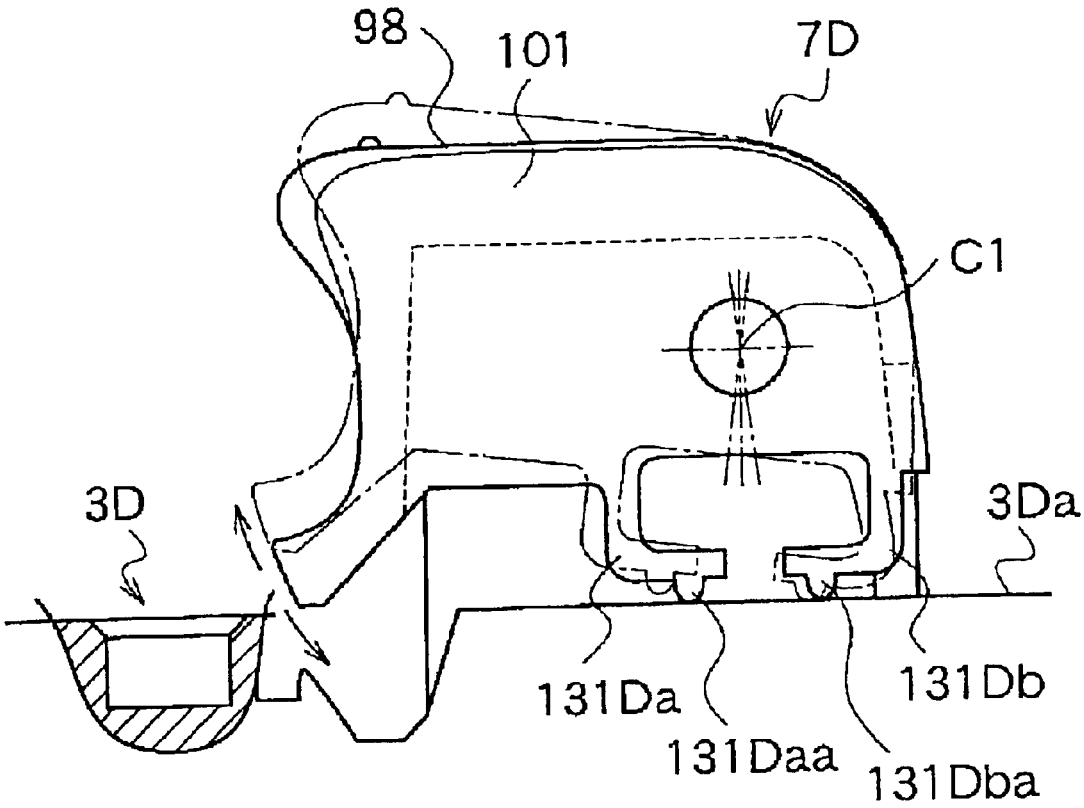
FIG. 18 is a side view of essential portions in a state in which a switch knob is attached to a switch case according to an embodiment of other modified example of the second embodiment.

Further, although the elastic leg portions 131*a* and 131*b* are formed in the diverging shape, the elastic leg portions can also be formed as shown by FIG. 17 and FIG. 18. FIG. 17 and FIG. 18 show an embodiment according to a modified example of the second embodiment. FIG. 17 is a side view of essential portions in a state in which a switch knob 7C is attached to a switch case 3C and FIG. 18 is a side view of essential portions in a state in which a switch knob 7D is attached to a switch case 3D.

In FIG. 17, contrary to the above-described elastic leg portions 131*a* and 131*b*, elastic leg portions 131C*a* and 131C*b* are formed to bend to an outer face 3C*a* constituting a receive portion of the switch case 3C to be proximate to each other in view from sides thereof. There is constructed a constitution in which front end sides of the elastic leg portions 131C*a* and 131C*b* are brought into elastic contact with the outer face 3C*a* of the switch case 3C. The respective elastic leg portions 131C*a* and 131C*b* are not provided with projections for contact at front end sides thereof and are not constituted as the elastic leg portions 131*a* and 131*b*, however, the projections can be provided similarly.

Also in FIG. 18, contrary to the above-described elastic leg portions 131*a* and 131*b*, elastic leg portions 131D*a* and 131D*b* are formed to bend to be proximate to each other toward an outer face 3D*a* constituting a receive portion of the switch case 3D in view from sides thereof. There is constructed a constitution in which front end sides of the elastic leg portions 131D*a* and 131D*b* are brought into elastic contact with the outer face 3D*a* of the switch case 3D. The respective elastic leg portions 131D*a* and 131D*b* are provided with projections 131D*aa* and 131D*ba* at front end sides thereof similar to the elastic leg portions 131*a* and 131*b*, however, the projections 131D*aa* and 131D*ba* can also be omitted similar to FIG. 17.

Also by the embodiments of FIG. 17 and FIG. 18, an effect substantially similar to that of the embodiment of FIG. 14 through FIG. 16 can be achieved.

Further, although according to the second embodiment, the elastic leg portions 131C*a*, 131C*b*, 131D*a* and 131D*b* are provided on the sides of the switch knobs 7C and 7D as elastic portions and the outer faces 3C*a* and 3D*a* are provided on the sides of the switch cases 3C and 3D as the receive portions, there can also be constructed a constitution in which the elastic leg portions 131C*a*, 131C*b*, 131D*a* and 131D*b* are provided on the sides of the switch cases 3C and 3D and the outer faces 3C*a* and 3D*a* are provided on the sides of the switch knobs 7C and 7D.

(Third Embodiment)

Figure 19:
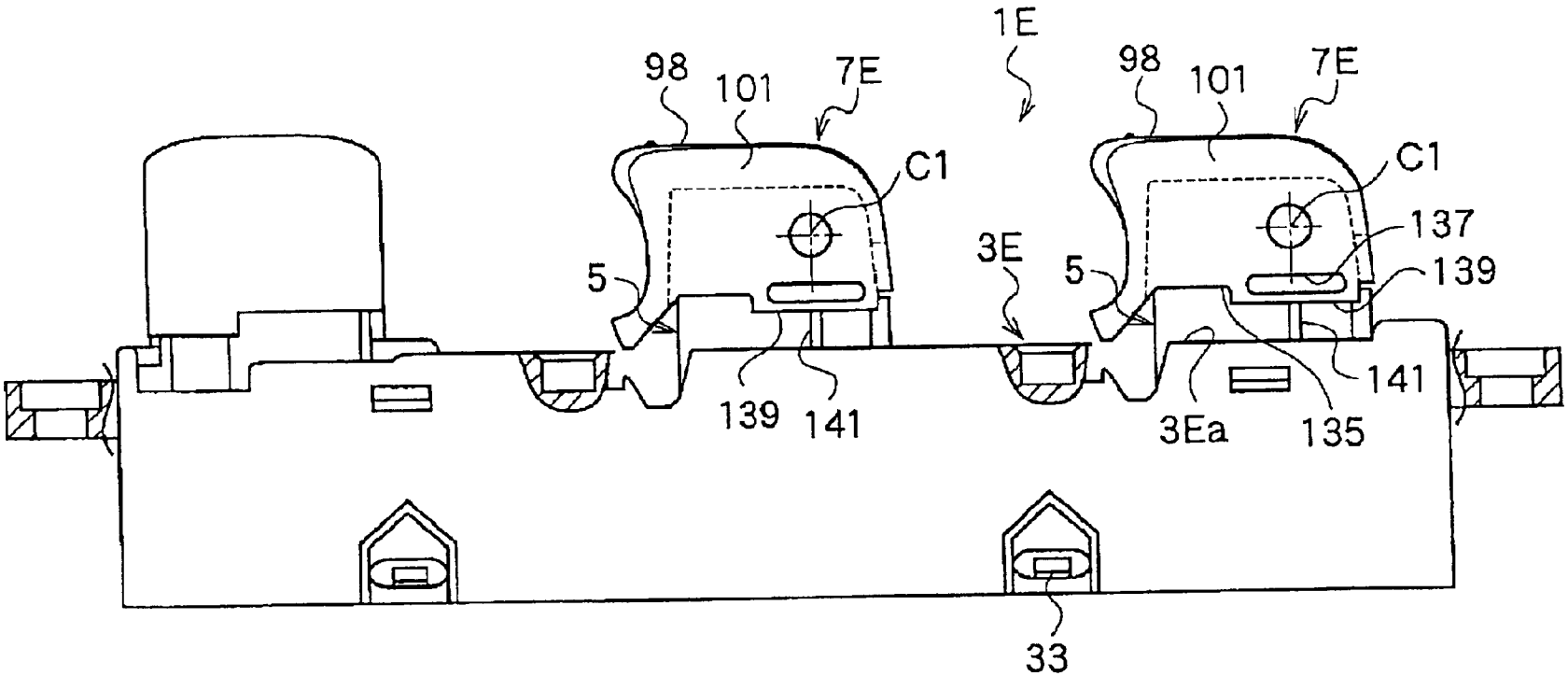
FIG. 19 is a side view of a power window switch according to a third embodiment of the invention.
Figure 20:
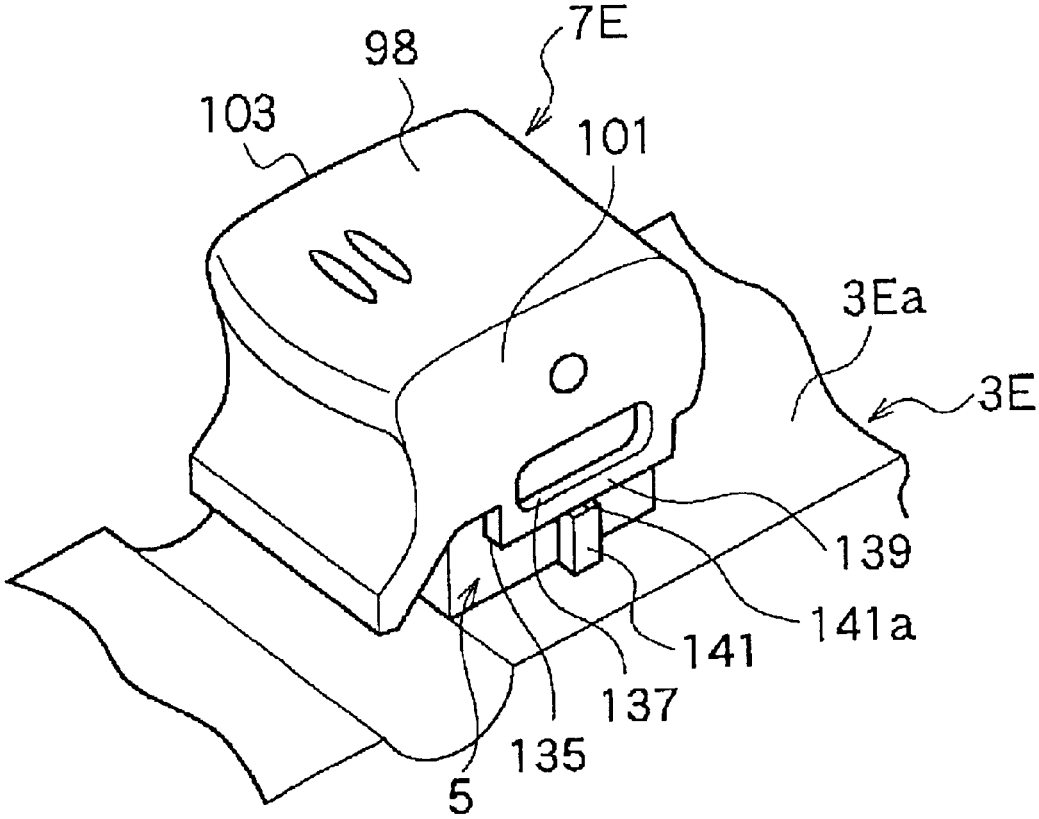
FIG. 20 is a perspective view of a periphery of a switch knob according to the third embodiment.
Figure 21:
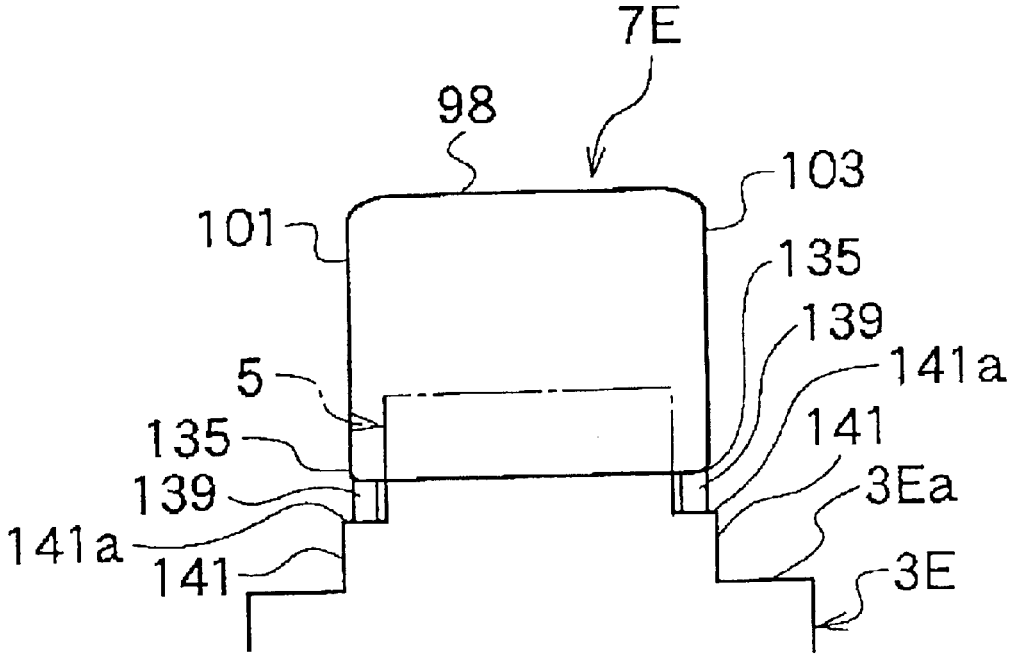
FIG. 21 is a rear view of the periphery of the switch knob according to the third embodiment.
Figure 22:
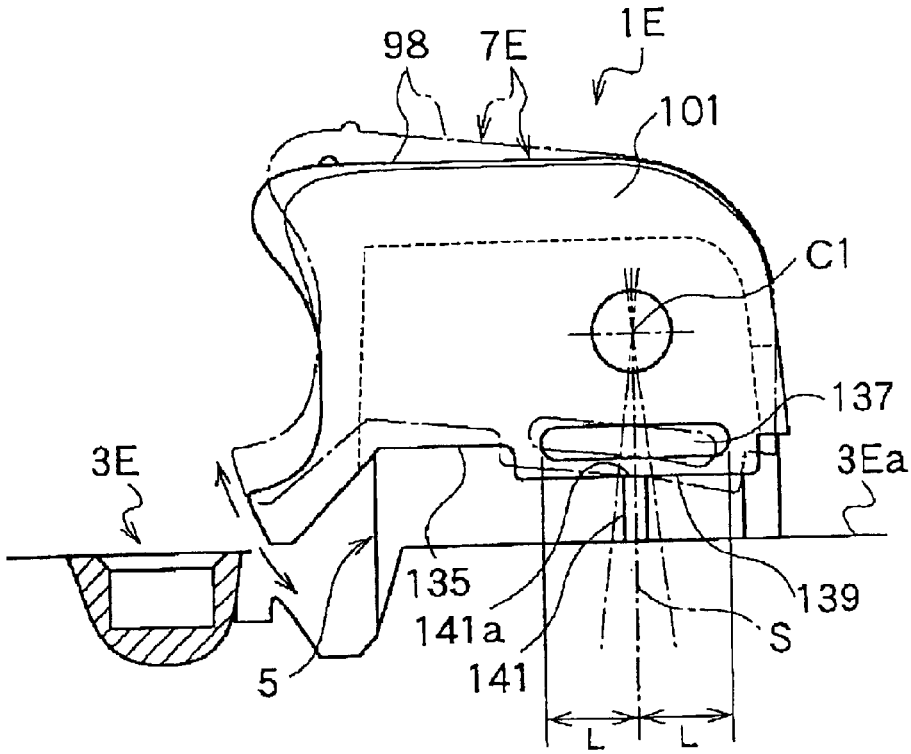
FIG. 22 is a side view of essential portions in a state in which the switch knob is attached to a switch case according to the third embodiment.
Figure 23:
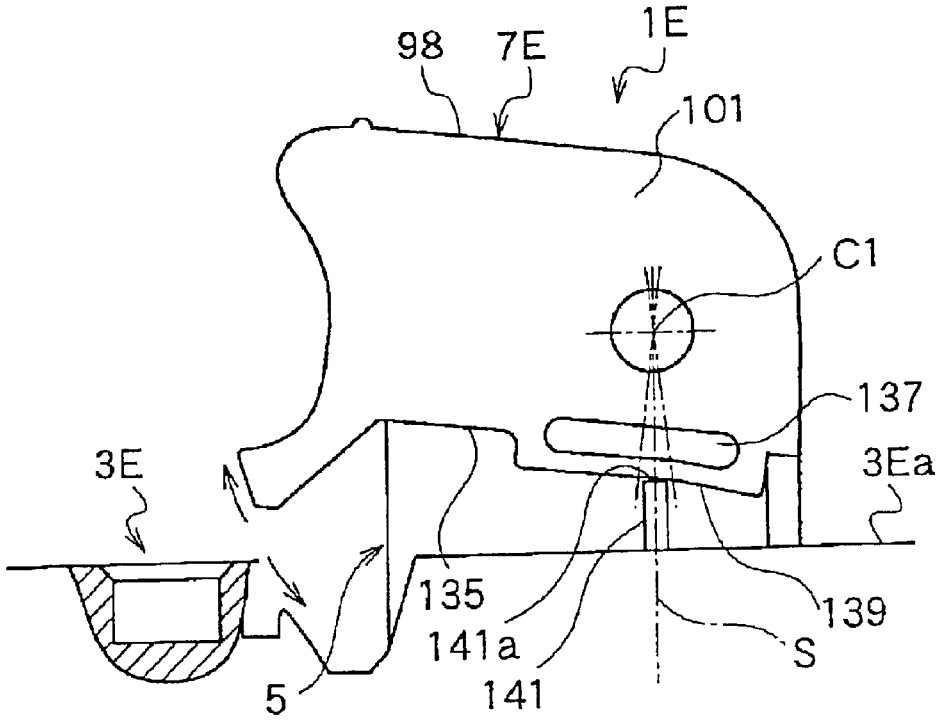
FIG. 23 is a side view of essential portions for explaining operation in the state in which the switch knob is attached to the switch case according to the third embodiment.

FIG. 19 through FIG. 23 show a third embodiment of the invention. FIG. 19 is a side view of a power window switch constituting a switch according to the third embodiment of the invention, FIG. 20 is a perspective view of a periphery of a switch knob, FIG. 21 is a rear view of the periphery of the switch knob, FIG. 22 is a side view of essential portions in a state in which the switch knob is attached to a switch case and FIG. 23 is a side view of essential portions for explaining operation in the state in which the switch knob is attached to the switch case.

Further, according to the embodiment, a constitution of the inside of the switch knob or the like is constructed by a structure similar to that of the first embodiment and there is provided a terminal block having a similar structure, although not illustrated. Therefore, an explanation will be given by attaching the same notations to constituent portions in correspondence with those of first embodiment. Further, an explanation will be given by attaching the same notations to a plurality of switch knobs 7E indicated by a power window switch 1E of FIG. 19 since operation and effect as embodiment of the invention are the same although specific functions differ.

According to the embodiment, as shown by FIG. 19 through FIG. 22, there are provided through holes 137 in a shape of a rectangular long hole at respective edge portions 135 of the both side wall portions 101 and 103 of the switching knob 7E. By the through holes 137, there are provided elastic portions 139 in a both end supporting state respectively at the edge portions 135 of the both side portions 101 and 103 by being disposed at the edge portions 135 of the switch knob 7E on the lower side of the pivoting center C1. However, there can also be constructed a constitution in which the elastic portion 139 is provided only at either one of the two side wall portions 101 and 103. The elastic portion 139 is slightly projected from the edge portion 135 of the switch knob 7E to an outer face 3E*a* of the switch case 3E. However, the elastic portion 139 can also be formed not to project from the edge portion 135 but along the edge portion 135. Further, as shown by FIG. 22, the elastic portion 139 is formed symmetrically with respect to an orthogonal line S right below the pivoting center C1, in other words, the pivoting center C1 to constitute lengths L in the front and rear direction in the direction of pivoting.

Further, the outer face 3E*a* constituting the receive portion of the switch case 3E, is provided with a projection 141 in a shape of a rectangular pillar integrally with the outer face 3E*a* and the knob attaching portion 5. The projection 141 can also be formed separately from the outer face 3E*a* and the knob attaching portion 5 and fixedly attached thereto by adhering or the like. Further, the projection 141 can be provided not on the side of the outer face 3E*a* but the side of the elastic portion 139. The projection 141 is formed symmetrically with respect to the orthogonal line S in the front and rear direction of the direction of pivoting. An upper end 141*a* of the projection 141 is formed to be flat. The upper end 141*a* of the projection 141 is always brought into contact with the elastic portion 139. By the contact, the elastic portion 139 can be bent slightly upwardly in the neutral state of the switch knob 7E. Thereby, the elastic reactive force in the upward direction can be provided to the switch knob 7E by the elastic portion 139 and the switch knob 7E can be held in the neutral state and play can be prevented further firmly.

By such a constitution, the elastic portion 139 can be deformed by changing a situation of bringing the side of the elastic portion 139 into contact with the projection 141 by operating to pivot the switch knob 7E. Specifically, the switch knob 7E can be pivoted by the same angle relative to the orthogonal line S by operating to pull up and press the switch knob 7E. FIG. 23 shows a state in which the switch knob 7E is operated to pull up, under the state, the elastic portion 139 is disposed to provide an angle relative to the upper end 141*a* of the projection 141, the elastic portion 139 is butted to a corner portion on the rear side of the upper end 141*a* of the projection 141 and the elastic portion 139 is deformed to bend to the side of the through hole 137 to thereby exert the elastic reactive force. Also when the switch knob 7E is operated to press and pivoted in a direction reverse to that of FIG. 23, the elastic portion 139 is deformed to exert the elastic reactive force by similar operation. Therefore, when the hand is separated from the switch knob 7E, by urging of the elastic portion 139, the switch knob 7E can firmly be returned to the neutral state.

In this way, also according to the embodiment, operation and effect substantially similar to those of the first embodiment can be achieved.

The elastic portion 139 is brought into the both end supporting state and rigidity of the elastic portion 139 per se can be increased. Therefore, a wall thickness or the like of the elastic portion 139 can be reduced and light-weighted formation and small-sized formation can further be expedited. Further, since the rigidity of the elastic portion 139 is increased, even when in molding the switch knob 7E by a mold, a jig pin brought into the mold for forming the through hole 137, is drawn in a lateral direction, the elastic portion 139 having the high rigidity can be prevented from being deformed by following the jig pin to be drawn. Therefore, the jig pin can easily be drawn from the mold and fabrication can be facilitated.

Further, although according to the third embodiment, the elastic portion 139 is provided on the side of the switch knob 7E and the outer face 3E*a* is provided on the side of the switch case 3E as the receive portion, there can be constructed a constitution in which the elastic portion 139 is provided on the side of the switch case 3E and the outer face 3E*a* is provided on the side of the switch knob 7E.

(Fourth Embodiment)

Figure 24:
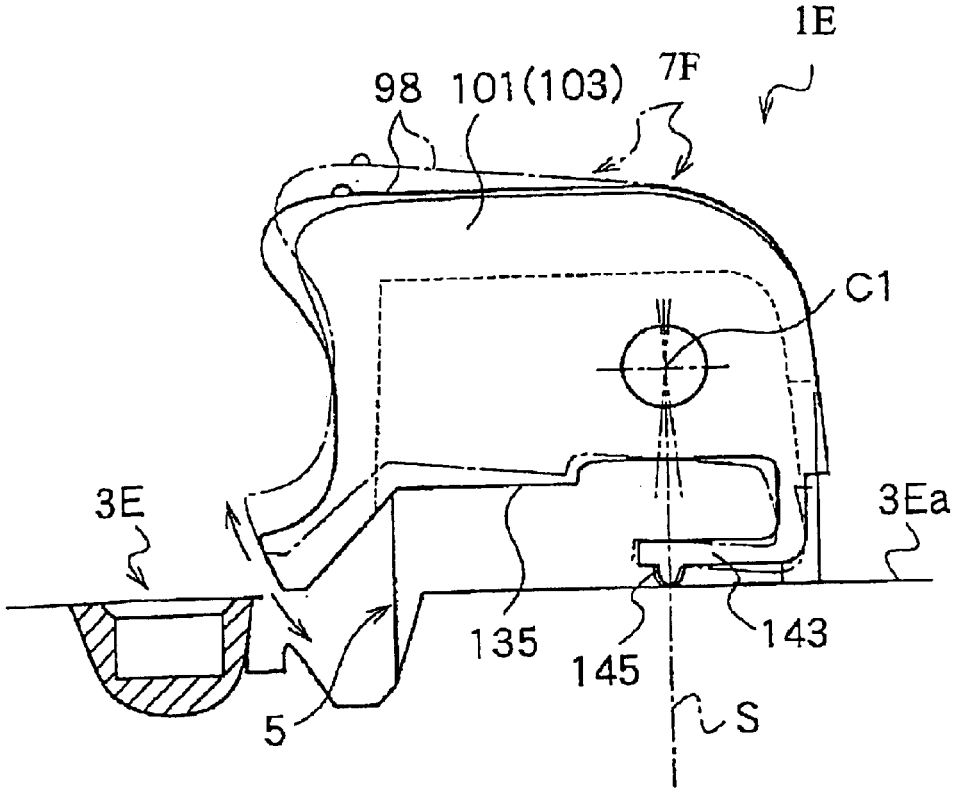
FIG. 24 is a side view of essential portions in a state in which a switch knob is attached to a switch case according to a fourth embodiment of the invention.
Figure 25:
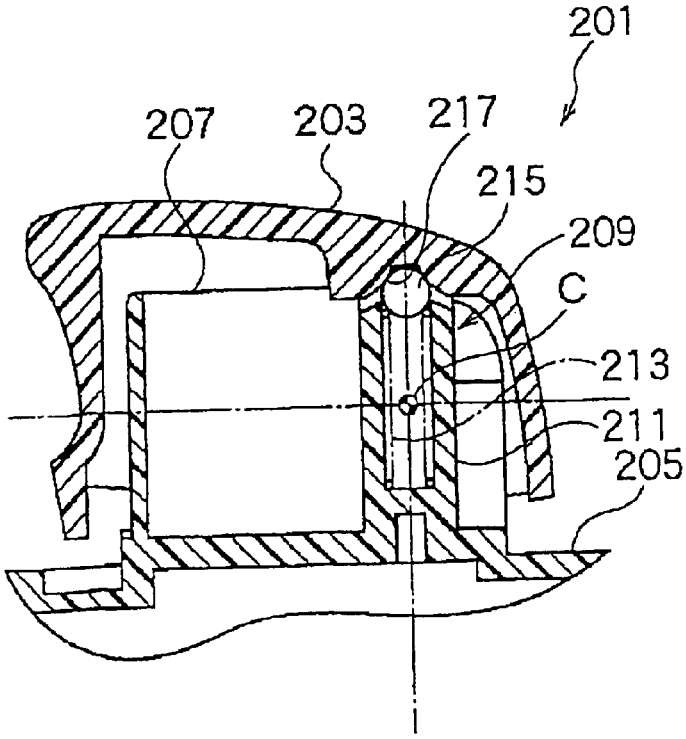
Fig.25 PRIOR ART
FIG. 25 is a sectional view of essential portions at a periphery of a switch knob according to a conventional example.

FIG. 24 shows a fourth embodiment of the invention and is a side view of essential portions in a state in which a switch knob is attached to a switch case. Further, a total constitution thereof is similar to that of the third embodiment and an explanation will be given by attaching the same notations to corresponding constituent portions.

As shown by FIG. 24, according to the embodiment, an elastic leg portion 143 of the switch knob 7F in the power window switch 1E, is integrally coupled to the edge portion 135 of the side wall portion 101 of the switch knob 7F at a position shifted from the orthogonal line S passing the pivoting center C1 to a rear side and is formed to bend to a front side. There is constructed a constitution in which a front end side of the elastic leg portion 143 is brought into elastic contact with the outer face 3E*a* constituting the receive portion of the switch case 3E. Although the respective elastic leg portion 143 is provided with a projection 145 for contact at the front end side, the projection can also be omitted. Contact of the elastic leg portion 143 to the outer face 3E*a* is carried out right below the pivoting center C1, in other words, on the orthogonal line S passing the pivoting center C1. Specifically, contact of the projection 145 to the outer face 3E*a* is carried out on the orthogonal line S.

On the side of the side wall portion 103 of the switching knob 7F, the elastic leg portion is integrally coupled thereto at a position shifted from the orthogonal line S to a front side, formed to bend to the rear side and is formed to arrange symmetrically with the elastic leg portion 143.

However, there can also be constructed a constitution in which the elastic leg portion is provided only on one side of the side wall portions 101 (103).

In this way, also according to the embodiment, operation and effect substantially similar to those of the above-described embodiments can be achieved. Further, according to the embodiment, the elastic reactive force in the upward direction can be provided to the switch knob 7F by the elastic leg portion 143, the switch knob 7F can be held at the neutral state and play can be prevented further firmly.

Although according to the embodiment of the invention, an explanation has been given of the power window switch of the pivoting type operating to pull up and push down the switch knob, the switch can also be used as a lever type switch by forming the operating portion 7*a* to be long as in a bar. That is, the invention may be a switch in which the operating knob is pivoted centering on the pivoting center C1, a shape of the operating portion of the operating knob and an operating method thereof are not limited.

Further, although according to the fourth embodiment, the elastic leg portion 143 is provided on the side of the switch knob 7F and the outer face 3E*a* is provided on the side of the switch case 3E as the receive portion, there may be constructed a constitution in which the elastic leg portion 143 is provided on the side of the switch case 3E and the outer face 3E*a* is provided on the side of the switch knob 7F.

What is claimed is:

1. A switch comprising an operating lever portion of a switch knob inserted from an opening of a knob attaching portion provided at a switch case, the switch knob being axially supported by the knob attaching portion to pivot, wherein an elastic portion is integrally provided with the switch knob and a receive portion for receiving a reactive force of the elastic portion is provided at the switch case;

when the switch knob is operated to pivot, the switch knob is urged to a neutral position relative to the knob attaching portion by an elastic force by deforming the elastic portion to the receive portion;

the elastic portion is an elastic projection projected from the switch knob into the opening of the knob attaching portion; and the receive portion is an engaging hole provided to the knob attaching portion for fitting and holding a front end of the elastic projection.

2. The switch according to claim 1, wherein the engaging hole is provided at a bottom portion of a spring containing portion containing a coil spring used in a switch knob having other specification; and the bottom portion of the spring containing portion is formed in a shape of a taper hole converging toward the engaging hole.

3. The switch according to claim 1, wherein the elastic portion is an elastic leg portion projected from the switch knob to an outer face of the switch case;

the receive portion is an outer face of the switch case; and the elastic leg portion is brought into elastic contact with the outer face of the switch case.

4. The switch according to claim 3, wherein the outer face of the switch case is provided with a groove for fitting and guiding a front end of the elastic leg portion.

5. The switch according to claim 1, wherein the elastic portion is formed by providing a through hole at an edge portion of the switch knob;

at either one of the elastic portion and the receive portion, a projection in contact with the other side is provided; and the elastic portion is deformed by changing a situation of bringing a side of the elastic portion or a side of the receive portion into contact with the projection by operating to pivot the switch knob.

6. The switch according to any one of claims 1 through 5, wherein a fixed contact is fixedly supported by a terminal block engageably and detachably attached to the switch case, a movable piece having a movable contact brought into contact with or separated from the fixed contact is pivotably supported and a slider having an elastic contact member brought into elastic contact with the movable piece and a cooperative engaging portion for engaging with the operating lever portion is movably supported; and the slider is moved in cooperation with the operating lever portion by operating to pivot the switch knob, the movable piece is pivoted by moving the elastic contact member on the movable piece and the movable contact is brought into contact with and separated from the fixed contact.

7. A switch comprising an operating lever portion of a switch knob inserted from an opening of a knob attaching portion provided at a switch case, comprising:

means for axially supporting the switch knob by the knob attaching portion to be capable of operating to pivot;

an elastic portion is integrally provided with the switch knob and a receive portion for receiving a reactive force of the elastic portion is provided at the switch case; and means, when the switch knob is operated to pivot, for urging the switch knob to a neutral position relative to the knob attaching portion by an elastic force by deforming the elastic portion to the receive portion, wherein the elastic portion is an elastic projection projected from the switch knob into the opening of the knob attaching portion; and the receive portion is an engaging hole provided to the knob attaching portion for fitting and holding a front end of the elastic projection.

* * * * *

UNITED STATES PATENT AND TRADEMARK OFFICE

CERTIFICATE OF CORRECTION

PATENT NO. : 6,911,612 B2
DATED : June 28, 2005
INVENTOR(S) : Hiroshi Seki

It is certified that error appears in the above-identified patent and that said Letters Patent is hereby corrected as shown below:

Title page,
Item [30], Foreign Application Priority Data, should read:

| | | |
|---|---|---|
| -- Aug. 30, 2001 | (JP) | P2001-262311 |
| Feb. 28, 2002 | (JP) | P2002-052877 --. |

Signed and Sealed this

Twentieth Day of December, 2005

JON W. DUDAS
*Director of the United States Patent and Trademark Office*